US006402044B1

(12) United States Patent
Sato

(10) Patent No.: US 6,402,044 B1
(45) Date of Patent: Jun. 11, 2002

(54) METHOD OF DAMPING RAILROAD NOISE AND RAILROAD NOISE DAMPING MEMBERS

(75) Inventor: Shozaburo Sato, Minoo (JP)

(73) Assignee: Yugen Kaisha Koshinsha, Osaka (JP)

( * ) Notice: Subject to any disclaimer, the term of this patent is extended or adjusted under 35 U.S.C. 154(b) by 0 days.

(21) Appl. No.: 09/482,523

(22) Filed: Jan. 14, 2000

Related U.S. Application Data

(63) Continuation-in-part of application No. 09/017,629, filed on Feb. 2, 1998.

(30) Foreign Application Priority Data

Feb. 3, 1997 (JP) ..... 9-20563
Dec. 10, 1997 (JP) ..... 9-339956

(51) Int. Cl.[7] ..... E01B 19/00
(52) U.S. Cl. ..... 238/382
(58) Field of Search ..... 238/382, 151, 238/172, 175, 266; 104/307

(56) References Cited

U.S. PATENT DOCUMENTS 3,100,080 A * 8/1963 Fiechter ..... 238/151
3,525,472 A * 8/1970 Sato ..... 238/151
4,775,103 A * 10/1988 Ortwein ..... 238/283
5,165,598 A * 11/1992 Ortwein ..... 238/283

* cited by examiner

*Primary Examiner*—S. Joseph Morano
*Assistant Examiner*—Robert J. McCarry, Jr.
(74) *Attorney, Agent, or Firm*—Wenderoth, Lind & Ponack, L.L.P.

(57) ABSTRACT

A method for reducing noises produced from a railroad when trains travel on rails. A vibration/noise damping member made of lead is fixed to the vertical rib portion of a rail, one side of a wheel, a joint bar for rails, or one side of a railroad overpass or iron bridge. The damper may have a plate shape or any other sectional shape. The vibration/noise damper effectively absorb and damp vibration energy and noises produced when trains travel on rails.

5 Claims, 25 Drawing Sheets

METHOD OF DAMPING RAILROAD NOISE AND RAILROAD NOISE DAMPING MEMBERS

This is a Continuation-in-Part of Ser. No. 09/017,629, filed Feb. 2, 1998.

BACKGROUND OF THE INVENTION

This invention relates to a method of damping noises produced from a railroad, especially noises produced when trains travel on rails, and railroad noise damping members.

When a train travels on a railroad, noise is inevitably produced. In view of the public nature of the railroad transportation system, people living along railroads have been forced to tolerate high levels of noise.

But today's high-speed trains tend to produce noises that are by no means tolerable to anyone. Noises produced from railroads are thus becoming a major social problem.

Railroads and subways produce noises from various parts thereof. For example, noises are produced when pantagraphs pass through the air or slide on electric cables. Air turbulance caused by unsmooth surfaces of trains is another cause of noises. Motors also produce noises. But by far the loudest noises produced from railroads are noises produced when wheels roll on rails, braking noises, squaking noises produced when trains are turning curves, and noises produced when wheels roll over rail joints.

But means are not yet known for preventing or suppressing such noises effectively, especially noises produced when wheels roll on rails. Thus, the growing noises are annoying people living along railroads.

An object of this invention is to provide a method for effectively damping noises produced when train wheels roll on rails.

Another object is to provide rail noise damping members.

SUMMARY OF THE INVENTION

According to this invention, there is provided a method of reducing noises produced from a railroad wherein a noise damping member is mounted on at least one side of a vertical rib of a rail so as to extend in the longitudinal direction of the rail.

According to this invention, there is also provided a rail noise damping member comprising a noise absorbing member in the form of a strip and a covering member of an elastic material for enclosing the noise absorbing member.

Other features and objects of the present invention will become apparent from the following description made with reference to the accompanying drawings, in which:

DETAILED DESCRIPTION OF THE PREFERRED EMBODIMENT

Embodiments of this invention will now be described with reference to the drawings.

FIGS. 1–13 show embodiments of railroad rails having noise-dampers. In the embodiment of FIGS. 1–10, noise dampers 3 are provided on one or both sides of vertical rib 2 of a rail 1 to extend in the longitudinal direction of the rail. The noise dampers 3 are made from a material that is heavy, soft and less likely to resonate, such as lead. Their weight and shape and how they are mounted should be determined according to the source of noises. Lead is a preferable material, because it has excellent noise damping properties and high and stable corrosion resistance in the atmosphere, and turns into a carbonate in the water and can be coated with a high polymer.

Figure 1A:
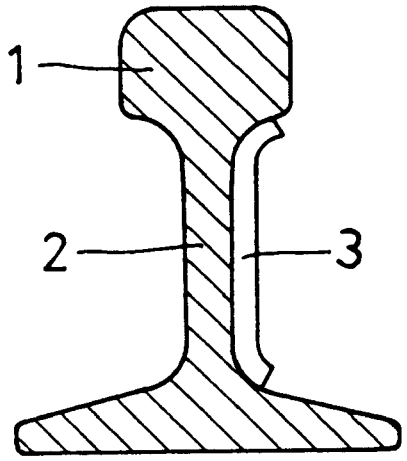
FIGS. 1A–1D are vertical sectional views of noise dampers of first to fourth embodiments as attached to a rail.

In the first embodiment of FIG. 1A, lead is made into noise dampers 3 in the shape of flat bars. The noise dampers 3 thus formed are bonded to one or both sides of the vertical rib 2 of a rail 1.

Figure 1B:
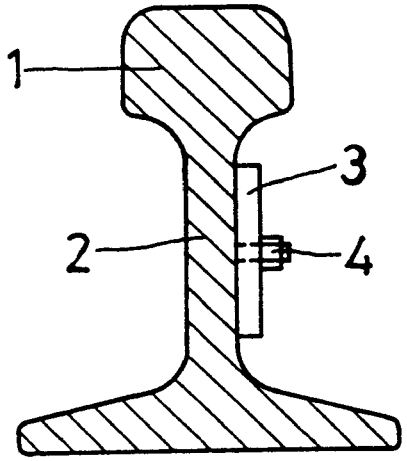

In the second embodiment of FIG. 1B, the same noise dampers 3 as used in the first embodiment are fixed to the vertical rib 2 of a rail by stud bolts 4.

Figure 1C:
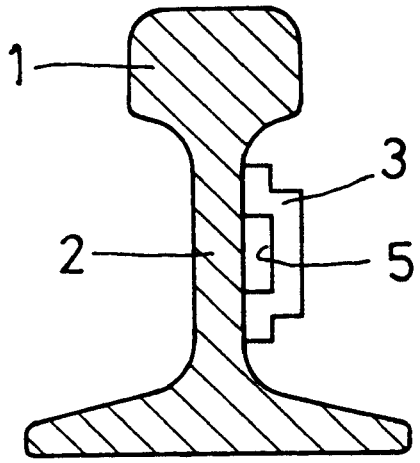

In the third embodiment shown in FIG. 1C, noise dampers 3 are formed by e.g. extrusion molding so that a recess 5 is formed in one side thereof, and bonded to one or both sides of the vertical rib 2 of a rail with the recesses 5 facing the rib 2.

Figure 1D:
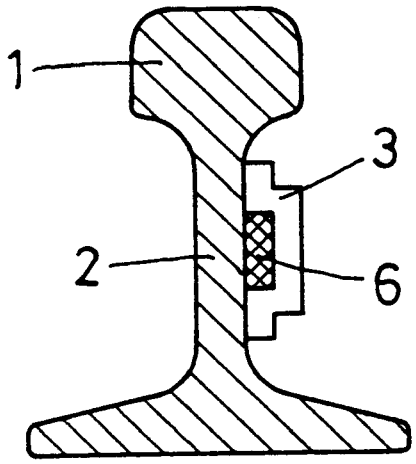

In the fourth embodiment shown in FIG. 1D, the same noise dampers used in the third embodiment are bonded to one or both sides of the rib 2 of a rail with the recesses 5 filled with a metal, typically aluminum, or a foamed material such as a resin.

Figure 2A:
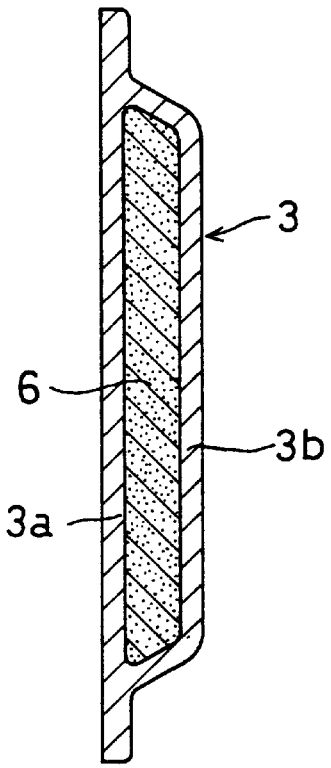
FIGS. 2A–2C are sectional views of noise dampers of fifth embodiment.
Figure 2B:
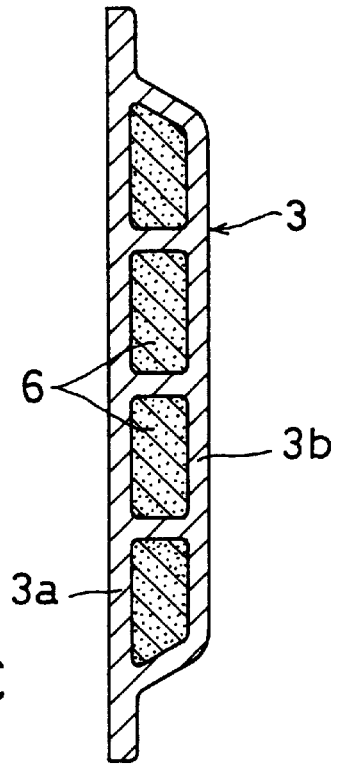
Figure 2C:
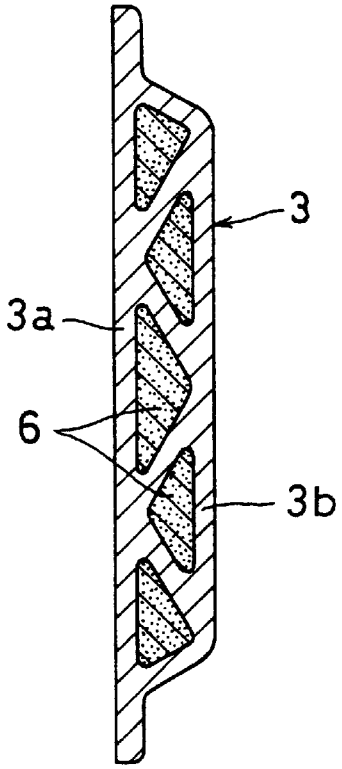

Noise dampers 3 of the fifth embodiment shown in FIGS. 2A–2C have hollow interiors with different sectional shapes. The hollow interiors may or may not be filled with the same foamed material 6 as used in the fourth embodiment.

Figure 5A:
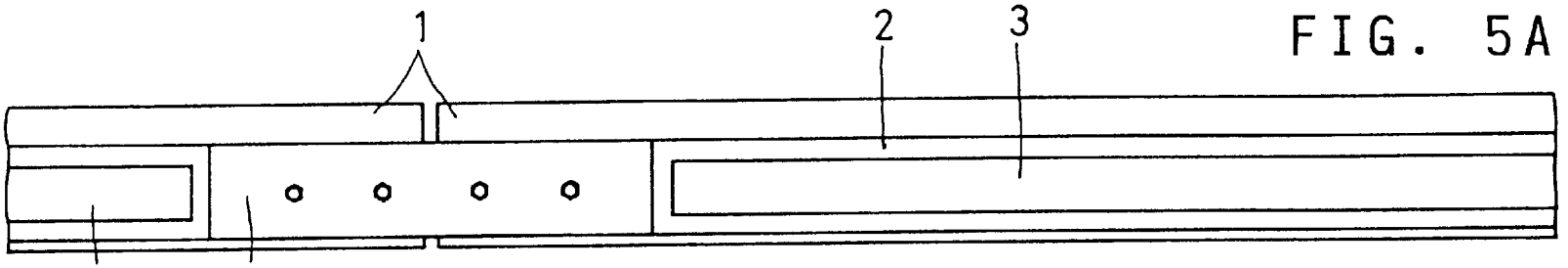
FIGS. 5A and 5B are front views of noise dampers mounted on rails.
Figure 5B:
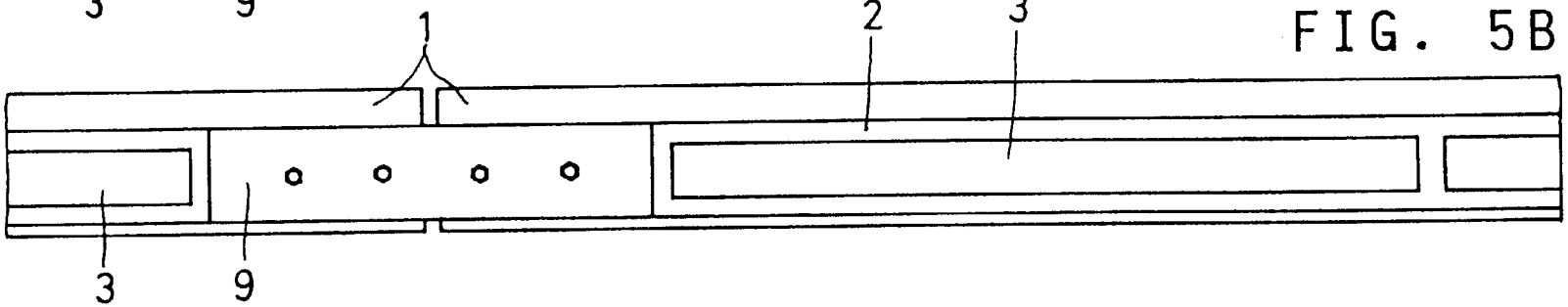

In any of the above embodiments, the noise dampers may be mounted to one side of the vertical rib 2 of a rail as shown in FIGS. 1A–1D, or may be mounted to both sides thereof for more efficient noise absorption. Such noise dampers can be mounted to the rib portions of rails in many different ways. For example, as shown in FIG. 5A, a single, long noise damper 3 may be mounted to a rail 1 over the entire length thereof. Also, as shown in FIG. 5B, a plurality of shorter noise dampers 3 may be mounted to a rail 1 so as to be arranged at intervals in the longitudinal direction of the rail.

Figure 3:
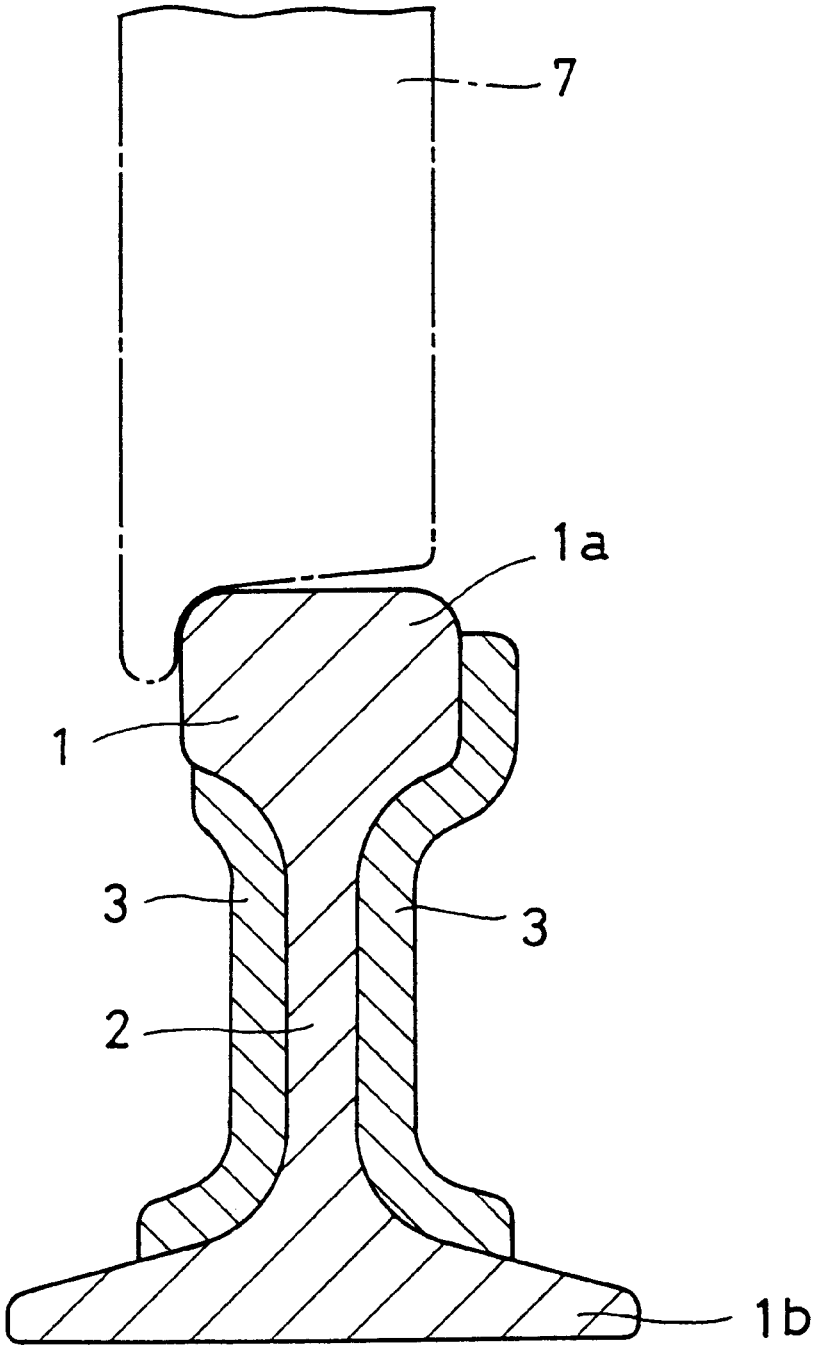
FIG. 3 is a vertical sectional view of noise dampers mounted on both sides of a rail.

In the embodiment of FIG. 3, noise dampers 3 are secured to both sides of each of a pair of rails running parallel to each other. Specifically, an integral noise damper 3 is mounted to the inner side of each rail, i.e. the side facing the other rail, so as to cover the bottom surface of the rail head 1*a*, the inner side of the vertical rib 2, and the top surface of the bottom portion 1*b*, whereas another noise damper 3 is secured to the other side of each rail so as to cover the side and bottom surfaces of the head 1*a*, the outer side of the vertical rib 2 and the top of the bottom portion 1*b*. Since the noise damper 3 secured to the outer side of the rail 1 covers a large area of the rail head 1*a*, it can directly absorb resonance of the head 1*a*.

Figure 4:
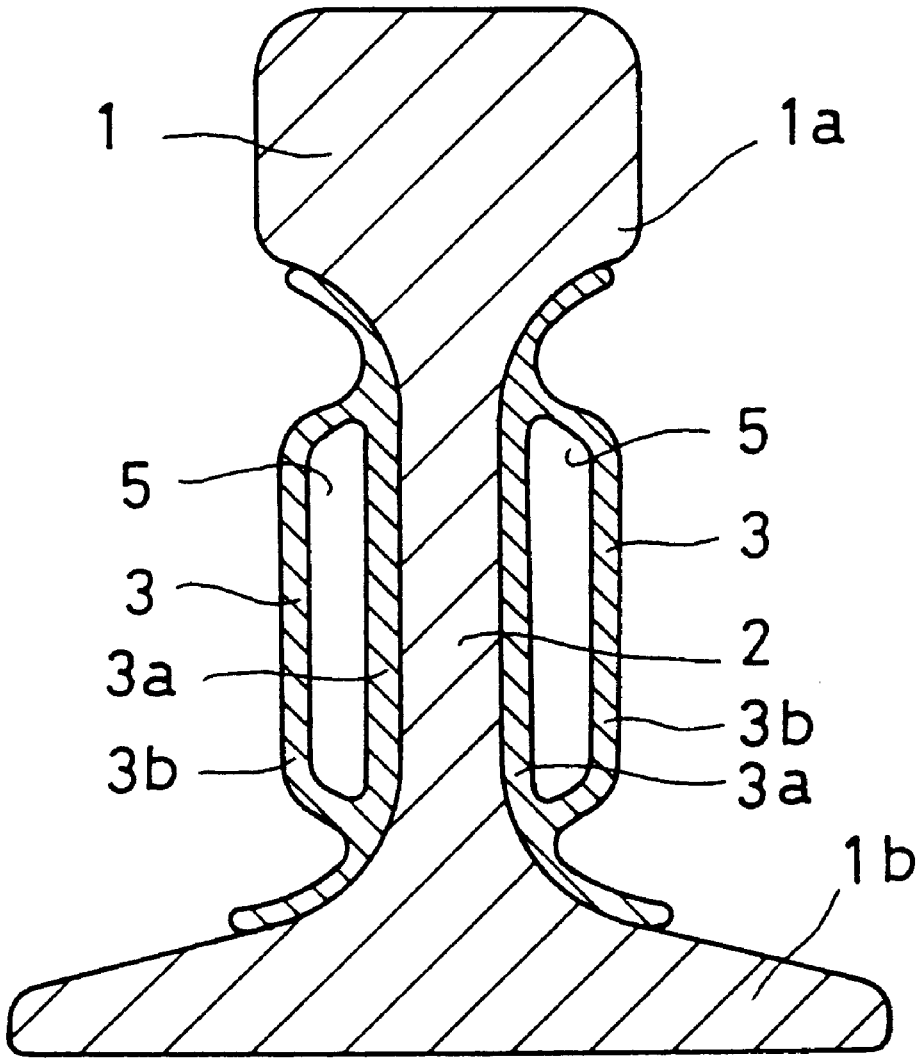
FIG. 4 is a vertical sectional view of different noise dampers mounted on both sides of a rail.

FIG. 4 shows an embodiment in which a noise damper 3 have a double wall structure to form a hollow space 5 between the double walls. The noise dampers 3 are secured to both sides of a rail 1.

Such noise dampers 3 can be formed in various ways. The noise dampers of FIGS. 1–4 are formed by molding. Noise dampers may be directly formed on one or both sides of a rail by spraying molten material on the surface of the rail to a required thickness. On the molecular level, the material thus deposited on the rail tangles with the material forming the rail. Such noise dampers need no separate fixing means and thus are extremely compact, so that they can be mounted very easily to either existing or brand new rails.

While a train is traveling on rails 1, the rails vibrate, and the rail vibrations turn to sounds. Such vibration-to-sound conversion occurs most remarkable at the rib 2 of a rail, because this portion is structurally thinner than other portions of the rail. By securing noise dampers 3 according to this invention to at least one side of the rib portion of the rail, the dampers 3, which are made of lead and thus heavy, effectively suppress resonance of the rail while absorbing vibration energy of the vertical rib 2, thus significantly damping noise from the rail 1.

A rail 1 produces noises when its thin portion vibrates due to impacts inflicted thereon, and the vibration energy is converted to sounds. Thus, the degree of resonance of sounds produced by a rail varies according to the relationship between the thickness and weight of the vertical rib 2 and the shape, thickness and weight of noise dampers 3 made of lead and attached to the rib 2.

The noise dampers shown in FIG. 2 are free of this problem. These noise dampers are hoop-shaped and have a double-wall structure comprising a back wall 3*a* to be attached to a side of a rail, and a bag-shaped front wall 3*b*. A hollow space defined between the walls 3*a* and 3*b* is filled with a noise-damping foamed material 6 such as aluminum or resin.

While a train is traveling on a rail 1, the vertical rib 2 vibrates vertically, producing sounds. The double-walled hoops let the sounds thus produced pass through the relatively thin back wall 3*a* while suppressing resonance. The remaining acoustic energy is disturbed and damped by the foamed material. Further, any resonant sounds are trapped by the front wall.

In this arrangement, instead of suppressing vibration energy of sounds produced by a rail 1 with heavy, solid lead hoops, the relatively thin back wall of each lead hoop absorbs vibration energy produced by a rail while a train is traveling while suppressing primary resonance; the foamed material disturbs and damps any remaining acoustic energy that has passed the back wall; and the front wall traps any resonant sounds.

This minimizes the escape of the acoustic energy produced while a train is traveling from other parts of the rail (such as its head and bottom).

FIGS. 6–10 show clamp means with which any of the noise dampers 3 shown in FIGS. 1–4 can be secured to a rail 1 without the need for any prior work on the rail.

Figure 6:
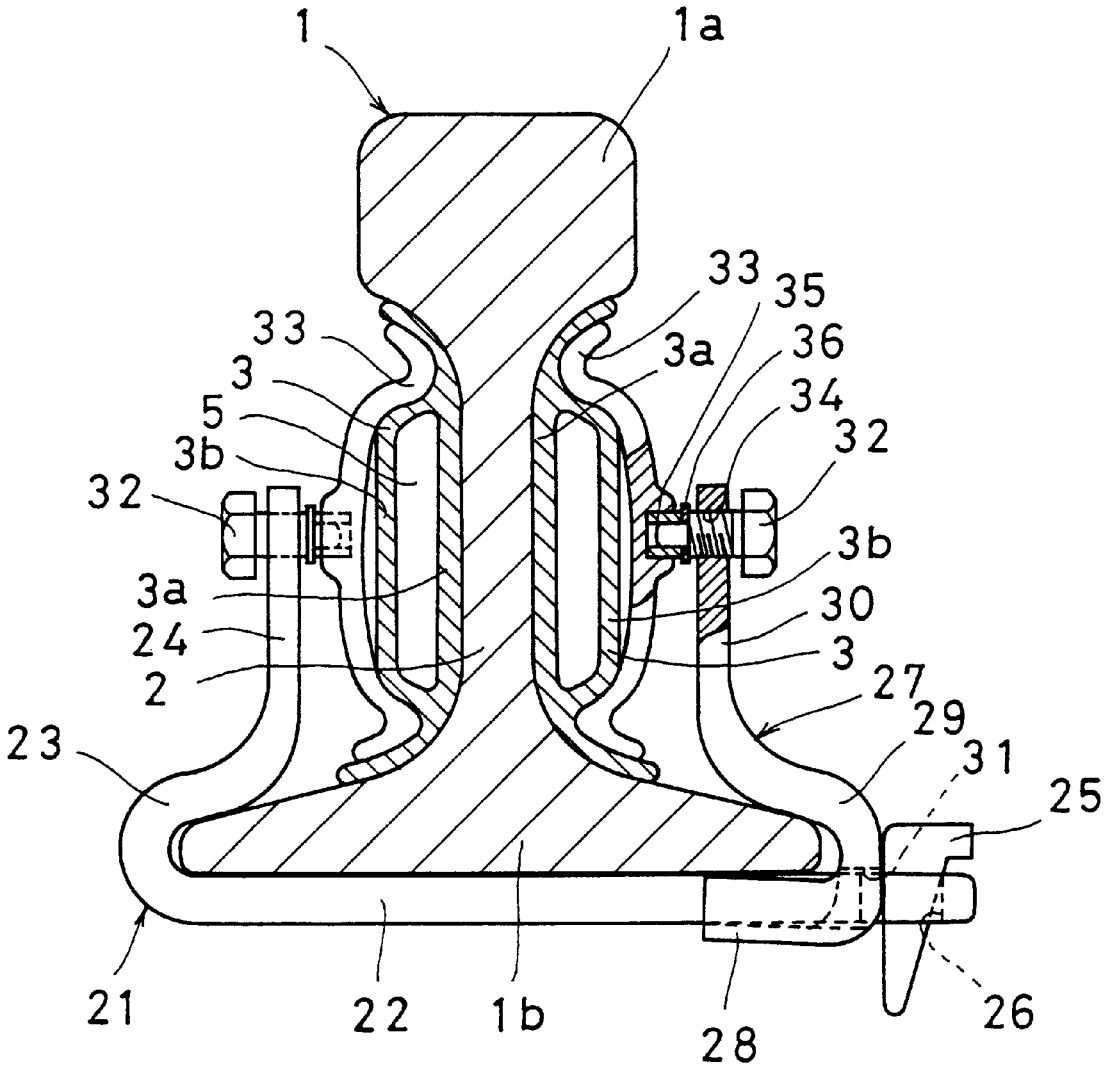
FIG. 6 is a vertical sectional view of a rail, a clamp means and noise dampers mounted on the rail by the clamp means.
Figure 7:
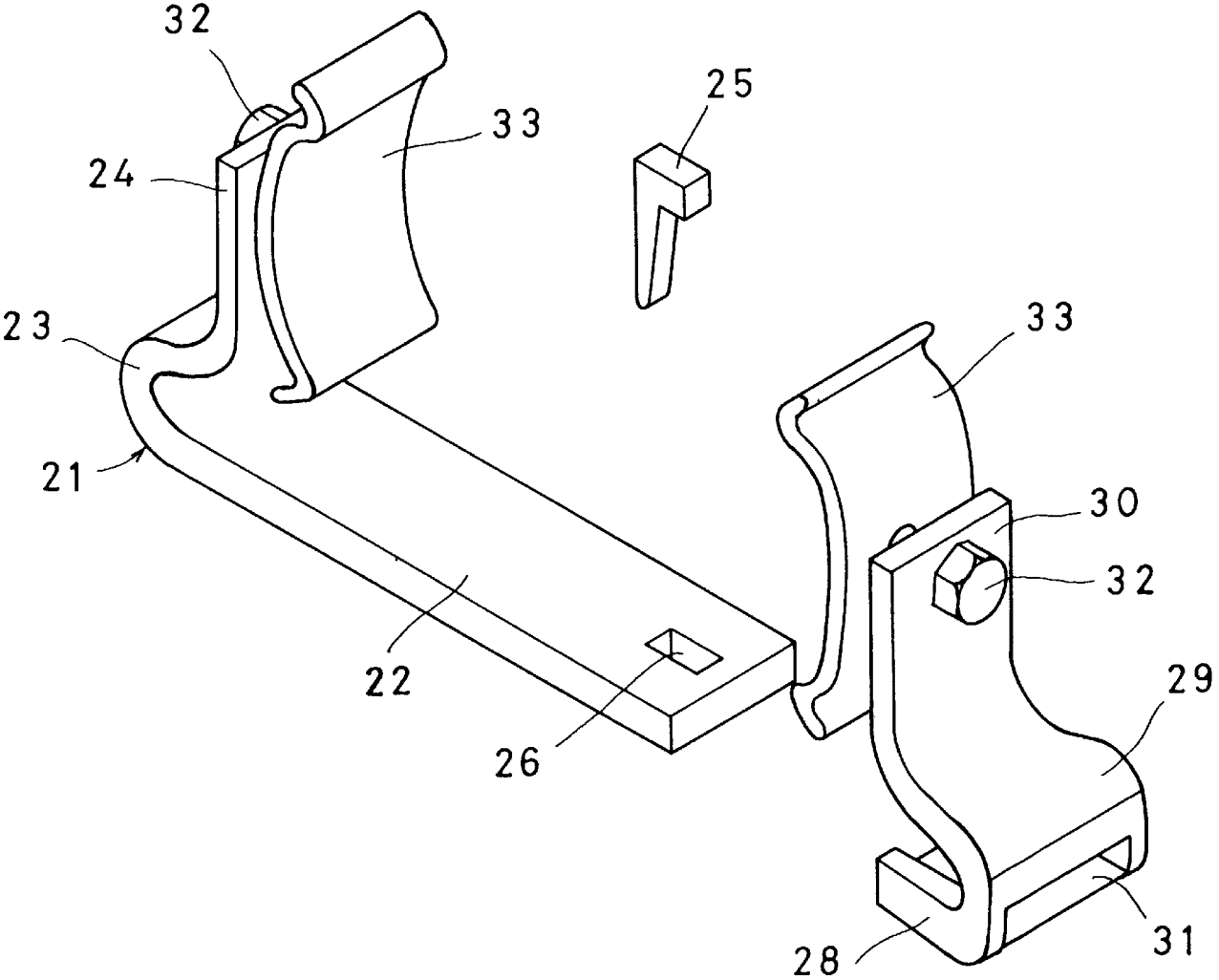
FIG. 7 is an exploded perspective view of the clamp means of FIG. 6.

The clamp means shown in FIGS. 6 and 7 includes a male member 21 in the form of an elongate metal strip comprising a straight bar portion 22 to be inserted under the bottom 1*b* of a rail 1, a bent portion 23 integrally connecting with one end of the straight bar portion 22, and an upright portion 24 integrally connecting with the top end of the bent portion 23. The straight bar portion 22 has near its other end a hole 26 into which a wedge 25 can be driven.

The clamp means further comprises a female metallic member 27 comprising a holder portion 28 forming a groove into which the straight bar 22 can be inserted, a bent portion 29 integrally connecting with one end of the holder 28 and adapted to engage the other side of the bottom 1*b* of the rail 1, and an upright portion 30 integrally connecting with the top end of the bent portion 29. At its lower portion, the bent portion 29 has a rectangular hole 31 through which the straight bar portion 22 can be inserted.

Presser plates 33 are secured to the respective upright portions 24 and 30 of the male and female members 21 and 27 by screws 32. The screws 32 are threadedly engaged in threaded holes 34 formed in the respective upright portions 24 and 30. Each presser plate 33 is inclinably supported at their backs on the tip of the respective screw 32 through an urethane ring 35 and a washer 36.

To fix noise dampers 3 to a rail 1, the male and female members 21 and 27 are set on both sides of the rail 1 with the noise dampers 3 sandwiched between the rail 1 and the male and female members so that the straight bar portion 22 extends under the rail. In this state, the straight bar portion 22 is inserted into the hole 31 in the female member 27, and the wedge 25 is driven into the hole 26 in the straight bar portion 22 to fix the male and female members 21, 27 to the rail 1.

The presser plates 33 are thus pressed against the noise dampers 3. By tightening the screws 32 in this state, the noise dampers 3 are fixed to the rail 1 and uniformly pressed against the rail.

Figure 8:
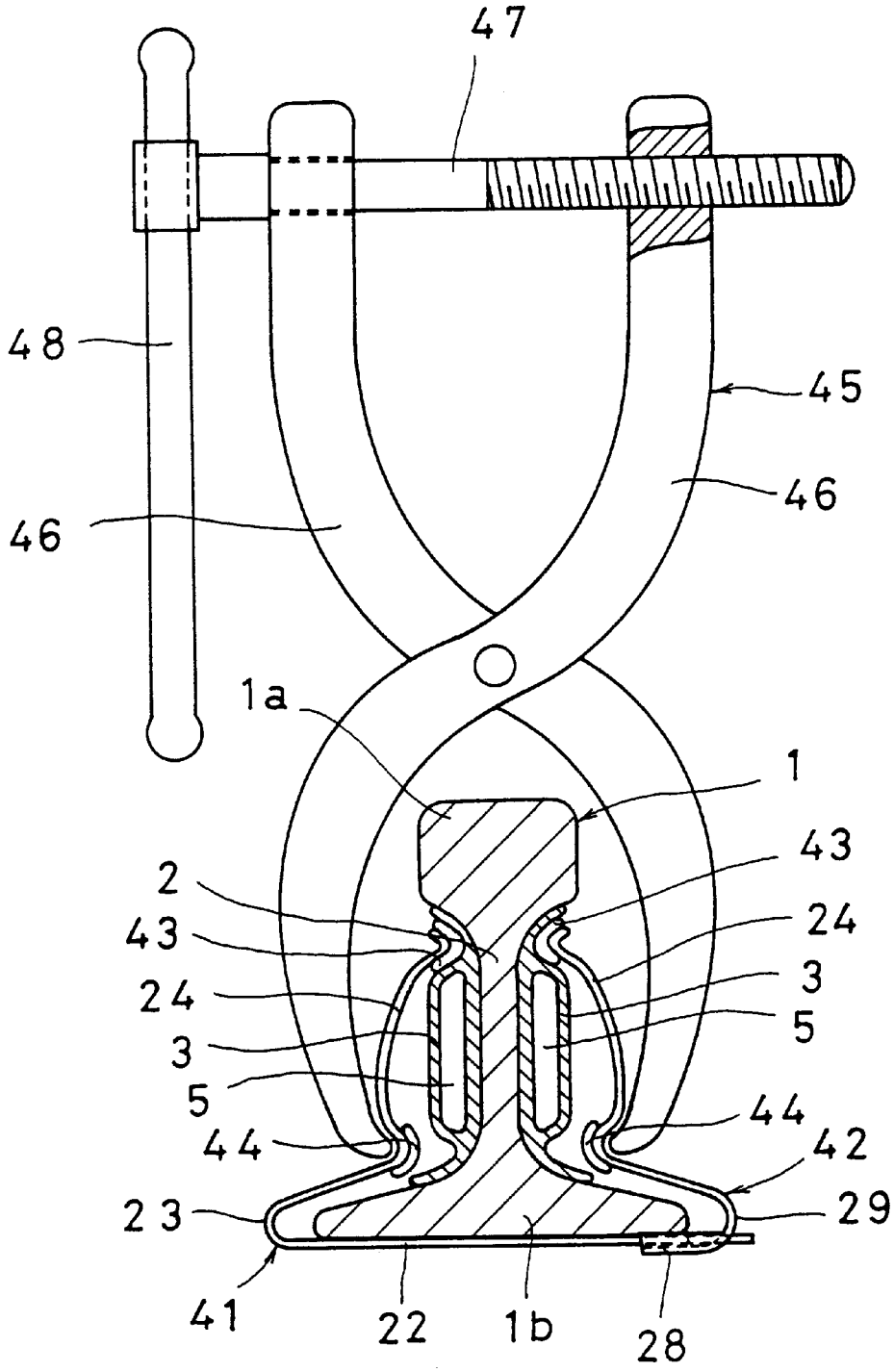
FIG. 8 is a front view in vertical section of noise dampers mounted on the rail by the clamp means when not yet tightened.
Figure 9:
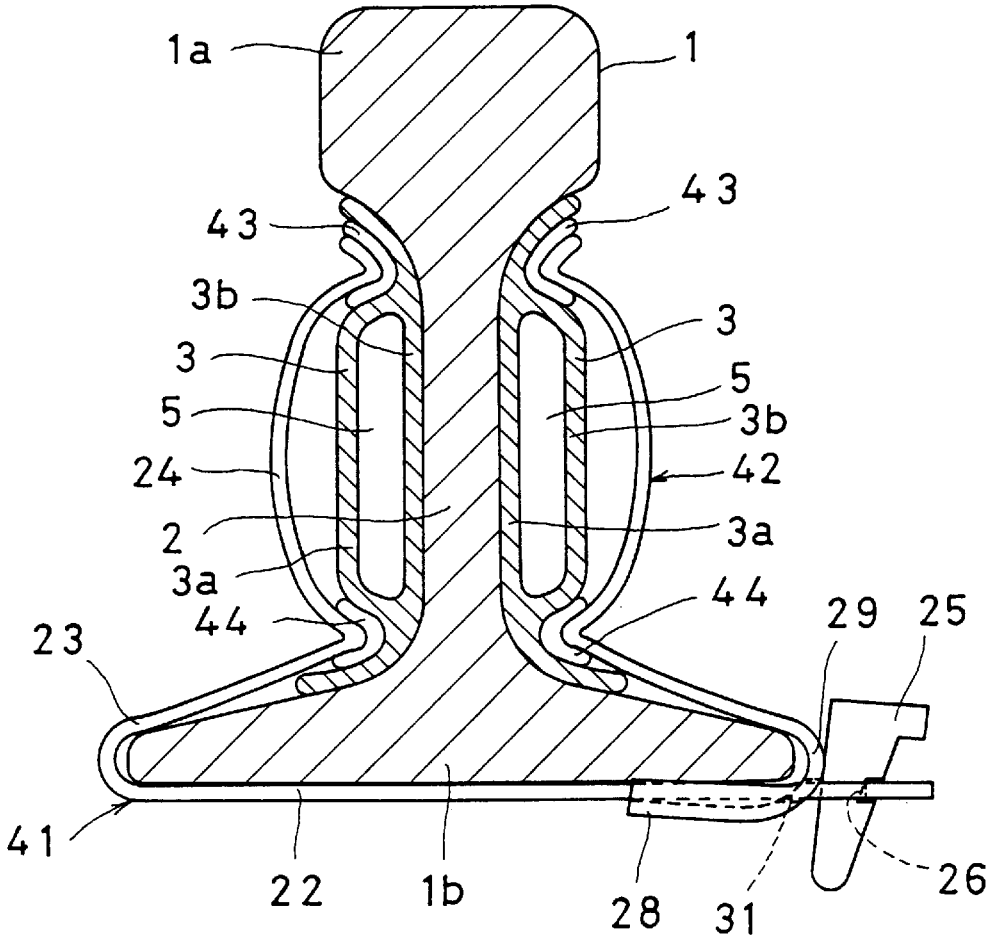
FIG. 9 is a vertical sectional view of the noise dampers of FIG. 8 when tightened against the rail.
Figure 10:
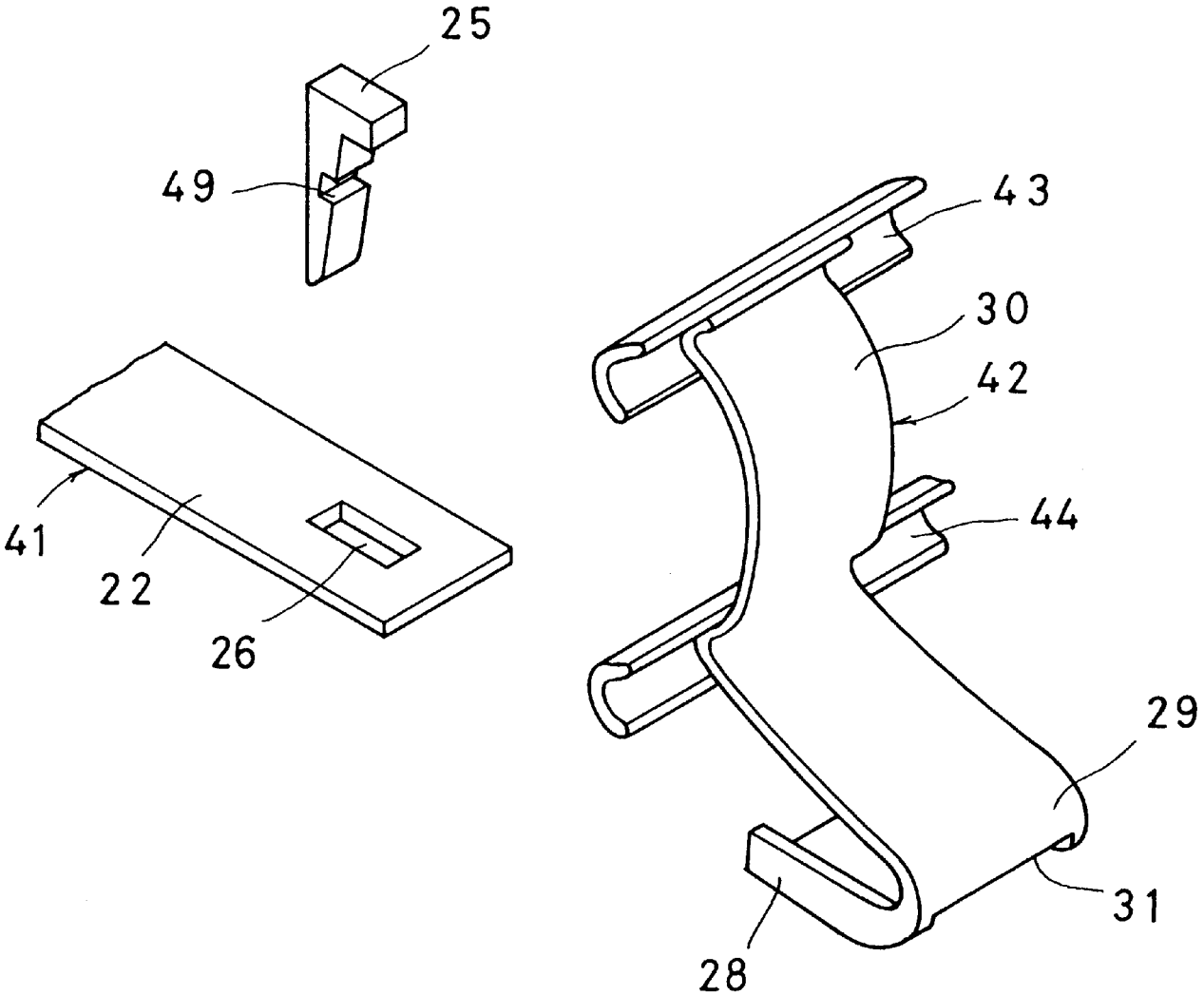
FIG. 10 is exploded perspective view of a clamp means of FIG. 8.

The clamp means shown in FIGS. 8–10 is a kind of resilient holder. This clamp means comprises a male and a female member 41, 42, both in the form of resilient metal strips. They are substantially identical in shape to the male and female members 21, 27 shown in FIGS. 6 and 7. Thus, like parts are designated by like numerals and their description is omitted.

Presser members 43 and 44 are secured to the top and bottom ends of the respective upright portions 24 and 30. The upright portions are made from a resilient material so that when the upper presser members 43 are in contact with the upper parts of the noise dampers 3, the lower presser members 44 are slightly spaced apart from the lower parts of the noise dampers 3.

A special tool 45 is used to fix the noise dampers to the rail 1 with the clamp means of this embodiment.

As shown in FIG. 8, the tool 45 comprises a pair of S-shaped clamp levers 46 crossing each other and pivotally coupled together at their central portions. A threaded shaft 47 having a handle 48 at one end thereof extends through the upper portions of the clamp levers 46. By turning the handle 48, the tips of the levers are moved toward and away from each other. But instead of the threaded shaft, fluid pressure may be utilized to pivot the levers.

To fix noise dampers 3 to a rail 1, the male and female members 41 and 42 are set on both sides of the rail 1 with the noise dampers 3 sandwiched between the rail 1 and the male and female members so that the straight bar portion 22 is slightly inserted in the rectangular hole 31 (FIG. 9). The tool 45 is then moved to a position where the tips of the levers 46 engage the proximal ends of the upright portions 24. In this state, the threaded shaft 47 is turned by turning the handle 48 to move the tips of the levers toward each other, thus moving the male and female members 21, 27 toward each other against the resilience of the clamp means so that the noise dampers 3 are pressed against the rail 1 by the presser members 43, 44. In this state, the wedge 25 is driven into the hole 26 in the straight bar portion 22 to fix the noise dampers 3 to the rail 1 by pressing the dampers 3 against both sides of the rail. The tool is then removed.

As shown in FIG. 10, the wedge 25 has a cutout 49 in its tapered surface. When the wedge 25 is driven into the hole 26 of the straight bar portion 22, the cutout 49 engages the edge of the hole 26, thus preventing the wedge from coming out of the hole.

Once the wedge 25 is driven in, the noise dampers 3 are resiliently held in position by the male and female members 41 and 42. Once fixed in position, the noise dampers will never loosen even when the rail vibrates or chatters due to the passage of trains.

Such clamp means are arranged in the longitudinal direction of the rail preferably at intervals of about 60 cm if the noise dampers 3 are 2–3 meter long. When the clamp means are used, no prior work on the rail is needed. Thus, the noise dampers can be easily fixed to existing rails. The noise dampers and the clamp means are both sufficiently durable so that the intervals between maintenances can be extended. An adhesive may be disposed between the noise dampers and the rail to absorb resonance more effectively.

The clamp means shown in FIGS. 1–10 are used mainly to fix noise dampers 3 to existing rails, i.e. rails already in service. The mounting structures shown in FIGS. 11–13 are used to fix noise dampers to brand new rails, i.e. rails yet to be brought into service.

Railroad rails 1 are formed into a predetermined shape by hot rolling.

Figure 11:
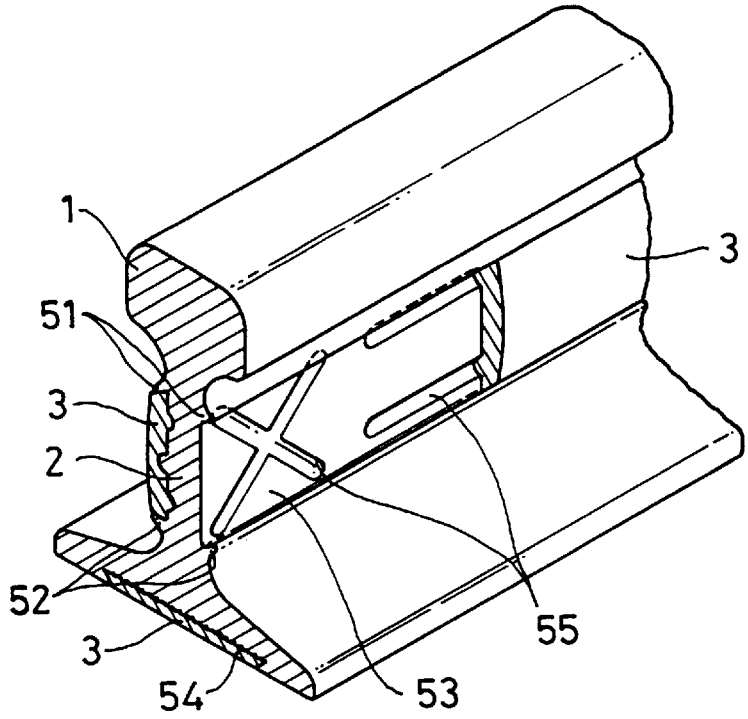
FIG. 11 is a perspective view of noise dampers mounted on a rail.
Figure 12:
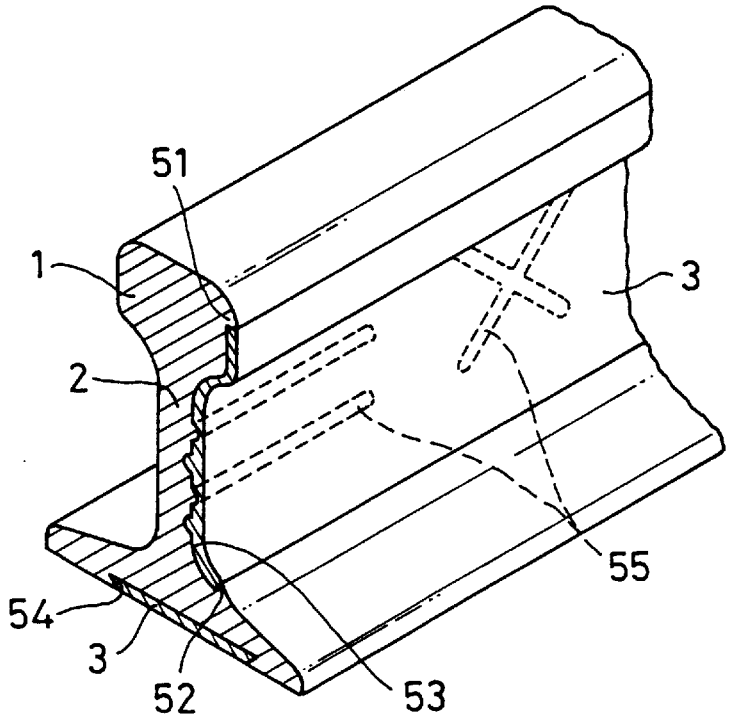
FIG. 12 is a perspective view of different noise dampers mounted on a rail.

The rail of FIG. 11 has ribs 51 and 52 formed on the upper and lower ends of each side of the vertical rib 2 of the rail 1 when the rail is formed by hot rolling. The ribs 51 and 52 define a continuous longitudinal groove 53 therebetween. Further, a longitudinal dovetail groove 54 is formed in the bottom of rail when the rail 1 is formed by hot rolling.

Noise dampers used in this embodiment are lead hoops complementary in section to the grooves 53, 54 of the rail 1 thus formed. The noise dampers or lead hoops are press-fitted into the grooves 53, 54 by pressure rolls to fix them to both sides and the bottom of the rail 1. Once the hoops are fitted in the respective grooves 53, 54, their surfaces become flush with the bottom surface and sides of the rail.

In the embodiment of FIG. 11, the rail 1 is further formed with vertical, horizontal and cross grooves 55 or ribs on both sides of the vertical rib 2 to fix the noise dampers more strongly to the rail and to suppress resonance more effectively. For the same purpose, similar grooves or ribs may also be formed on the bottom of the rail. In the embodiment of FIG. 12, noise dampers 3 are provided on only one side of the rail 1 so that their heads partially cover the flange of the rail. In this arrangement, it is possible to form fairly deep grooves in the rail because such grooves have only to be formed in one side of the rail.

Figure 13A:
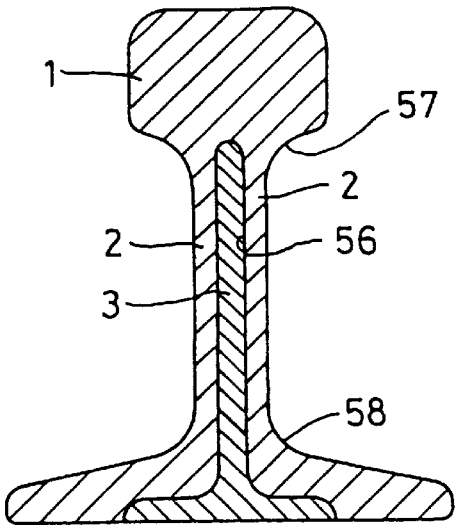
FIGS. 13A and, 13B and 13D are sectional views of a rail in which is embedded noise damper.

The rail of the embodiment shown in FIG. 13A has a vertical groove 56 extending through the vertical rib 2 and having a wide opening at the bottom of the rail. As a noise damper, molten lead is poured into the groove 56 and pressure is applied thereto from the bottom of the rail.

In this embodiment, the vertical rib 2 is bifurcated by the groove 56. The width of the groove 56 adds to the width of the rib 2. Since the rib 2 is wide, the rail stands more stably and is less likely to shake. Upper and lower arcuate portions 57 and 58 strongly resist the force that tends to spread the right and left legs of the rib 2.

Figure 13B:
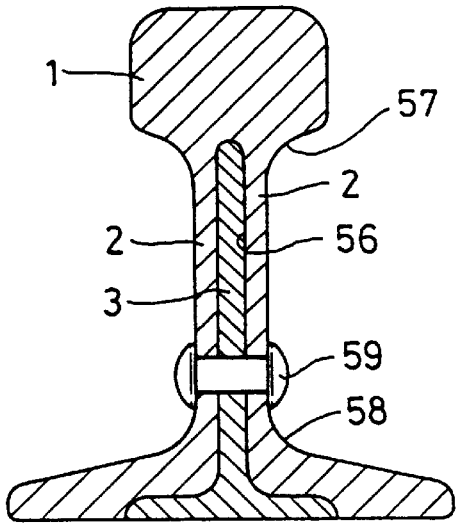
FIG. 13C is sectional view of another clamp means.
Figure 13C:
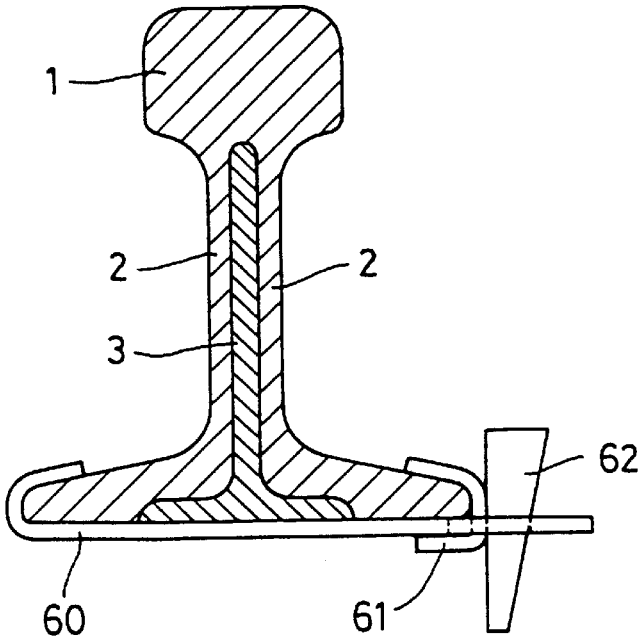

Although the legs of the vertical rib are prevented from spreading by tie binders, the bottom of the rail 1 is further reinforced by clamping the legs with a bolt and nut or a cold-pressed rivet 59 in the embodiment of FIG. 13B. For the same purpose, in the embodiment of FIG. 13C, the bottom of the rail 1 is pressed from both sides by fitting a first holder 60 in the form of a metal strip on one of the bottom flanges of the rail 1, fitting a second holder 61 on the other bottom flange, and driving a wedge 62 into the hole formed in the first holder 60. In either arrangement, there is no need to change the width of the bottom of the rail, so that conventional rail structures can be used as it is.

Figure 13D:
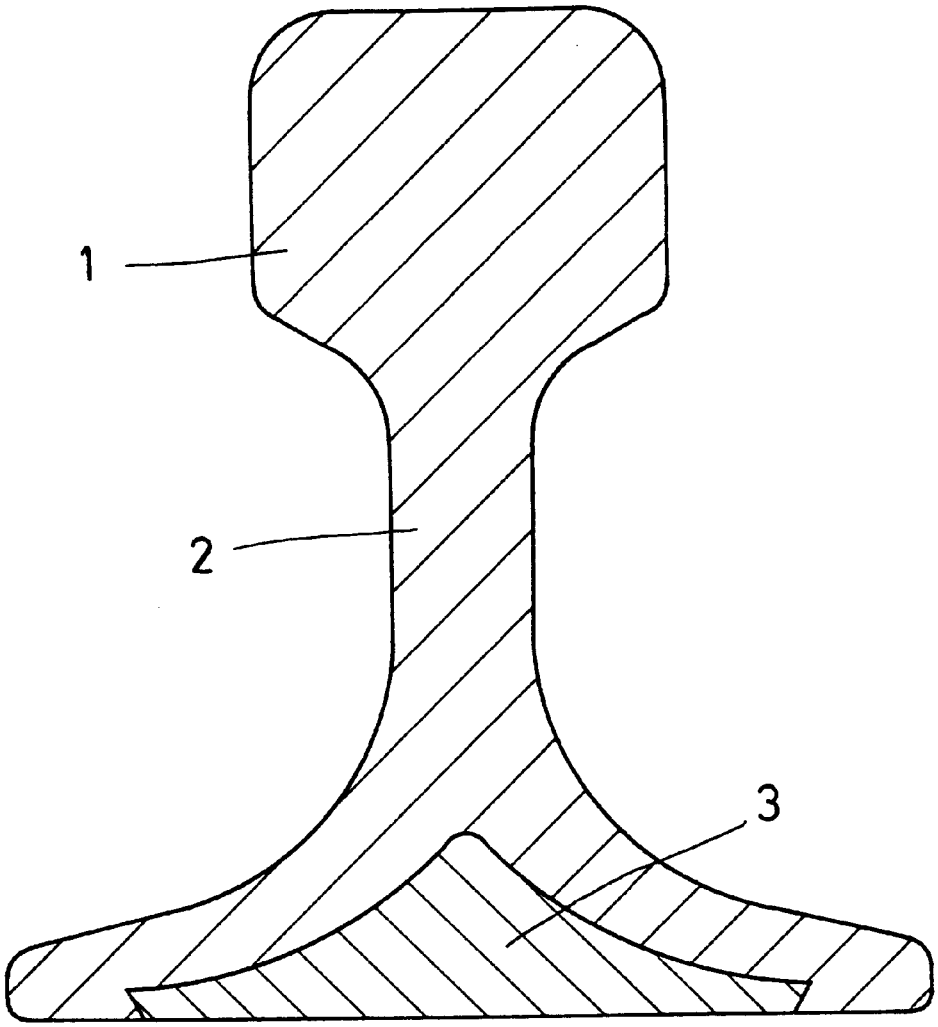

FIG. 13D shows another embodiment of a rail in which is embedded a noise damper.

The recess at the bottom of the rail is formed when the rail body is formed during hot rolling. A lead rod is placed in the bottom recess and pressed in by a pressure roller.

The arcuate portion at the root of the pillar portion is made thick to strengthen the pillar. The bottom has double-leg structure, so that the rail rigidity increases and vibration of the rail itself decreases.

Due to the double-leg structure, the rail stabilizes and is made more rigid, and the lead at the bottom suppresses and absorbs vibration of the pillar and resonance of the bottom into a low-noise rail.

Although the present rail is a little expensive, since outer dimensions of the rail are unchanged, it is possible to use conventional ties and fixing tools for construction of new rails or replacement of conventional rails. Compared with sound-proof walls, the construction time and cost are low as a whole.

FIGS. 14–17 show embodiments in which noise dampers 3 are mounted on a wheel 7. In the embodiment of FIG. 14A, noise dampers 3 are stuck on one or both sides of the hub 8 of a wheel 7. In the embodiment of FIG. 14B, a noise damper 3 is formed by pouring soundproof material into the hub 8 of a wheel. In the embodiment of FIG. 14C, a noise damper 3 is mounted on the outer end face of a wheel 7.

While a vehicle carrying wheels as shown in FIG. 14 is traveling on rails, the wheels impact the rails, thus producing noises. For example, noises are produced due to the wheels passing over rail joints, sinking of ties, warp of rails between ties, and curves of the rails.

Train wheels have no resonance-preventive means such as ties for rails. Thus, noises are produced from a wheel tire and hub when the wheels impact a rail or when the brake is applied.

Figure 14A:
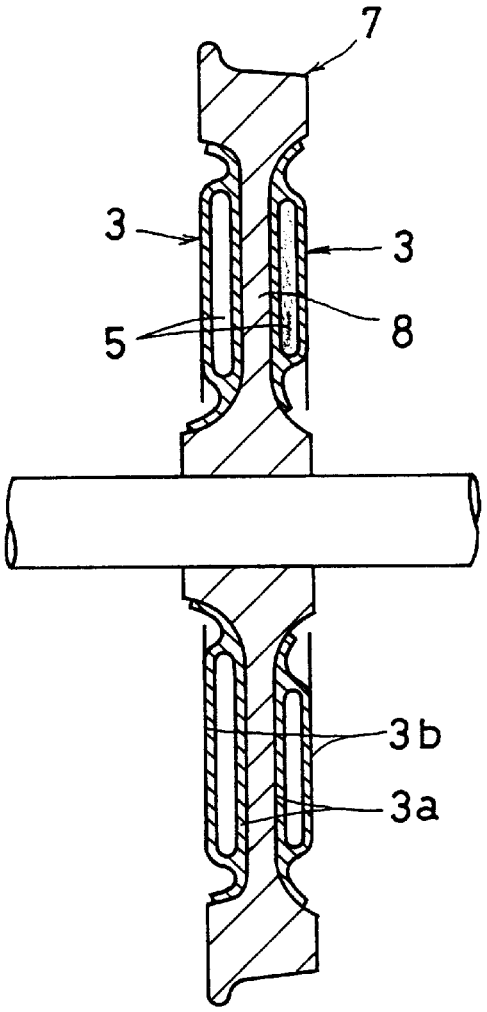
FIGS. 14A–14C are partially cutaway front views of various noise dampers mounted on a wheel.
Figure 14B:
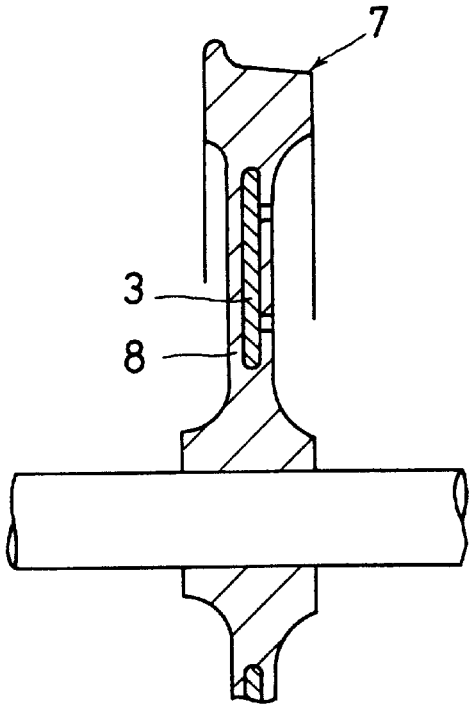
Figure 14C:
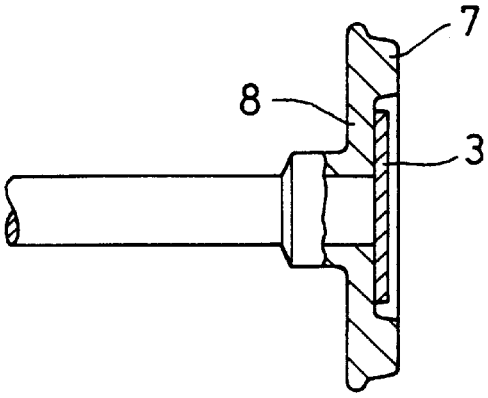
Figure 15A:
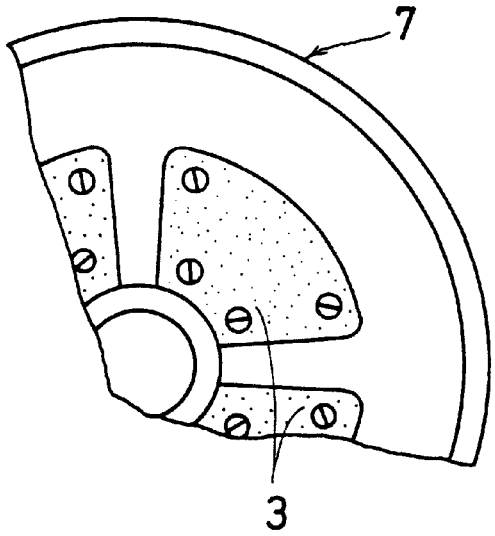
FIGS. 15A–15C are partially cutaway front views of different noise dampers mounted on a wheel.
Figure 15B:
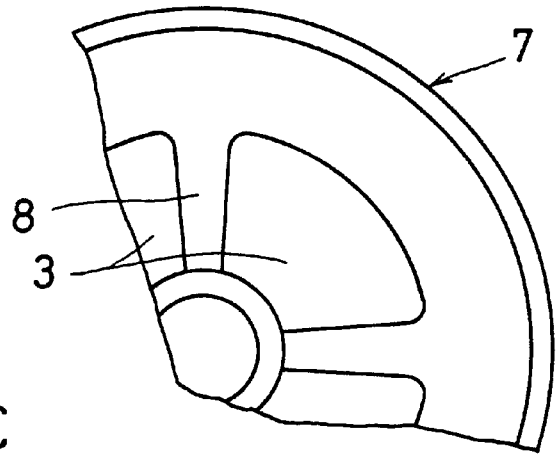
Figure 15C:
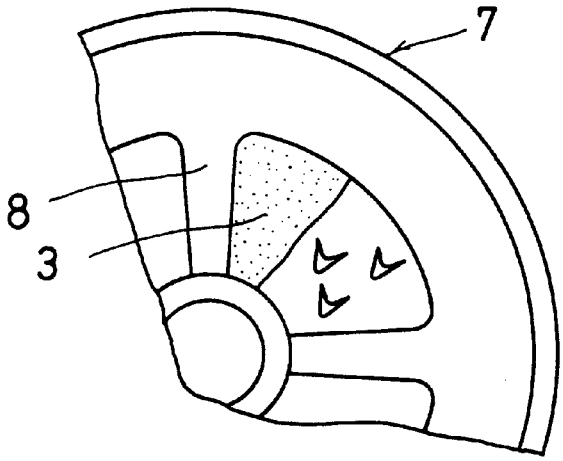

Such noises can be damped considerably by attaching noise dampers which are similar in sectional shape to those attached to rails to the hub of a wheel 7 as shown in FIG. 14A. Such noise dampers 3 may be formed by poring molten damper material into the hub as shown in FIGS. 14B and 15C. Otherwise, they may be plate members bolted to the wheel as shown in FIG. 15A.

Figure 16A:
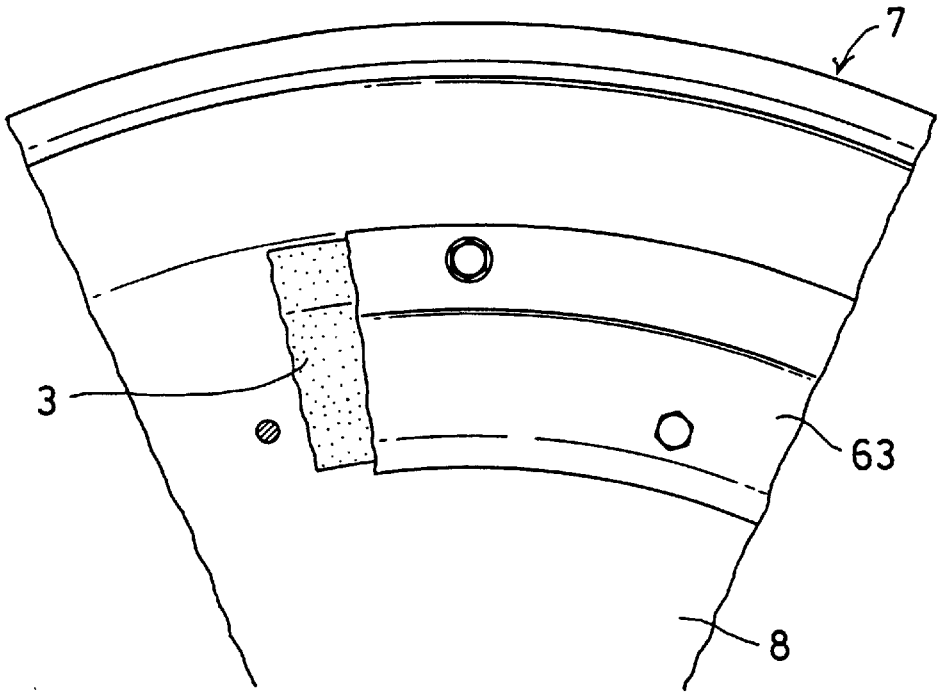
FIG. 16A is a front view of a noise damper mounted on a wheel.
Figure 16B:
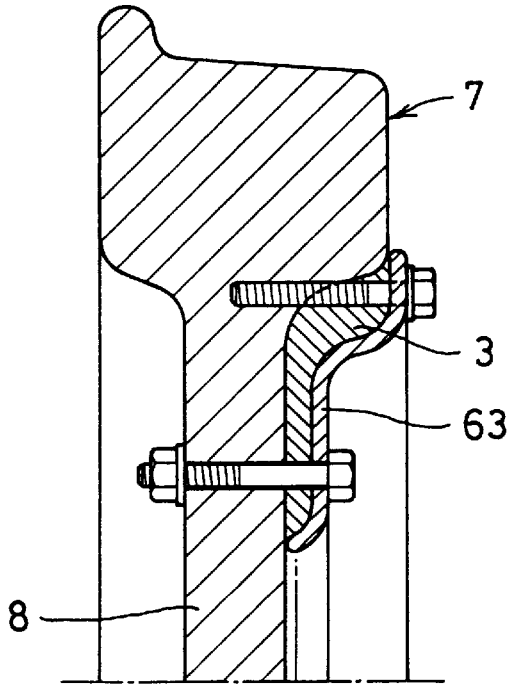
FIG. 16B is a vertical sectional view of FIG. 16A.

In the embodiment of FIG. 16, an annular noise damper 3 is fitted in a shoulder formed between the rib and the tire of the wheel 7 and bolted to the wheel.

The shoulder prevents the annular noise damper 3 from coming off the wheel under centrifugal force. A cover 63 made of e.g. carbon fiber may be put on the noise damper 3. This noise damper can be very easily mounted on an existing train wheel. A noise damper having a greater radial width may be used to cover a greater area of the rib.

Figure 17A:
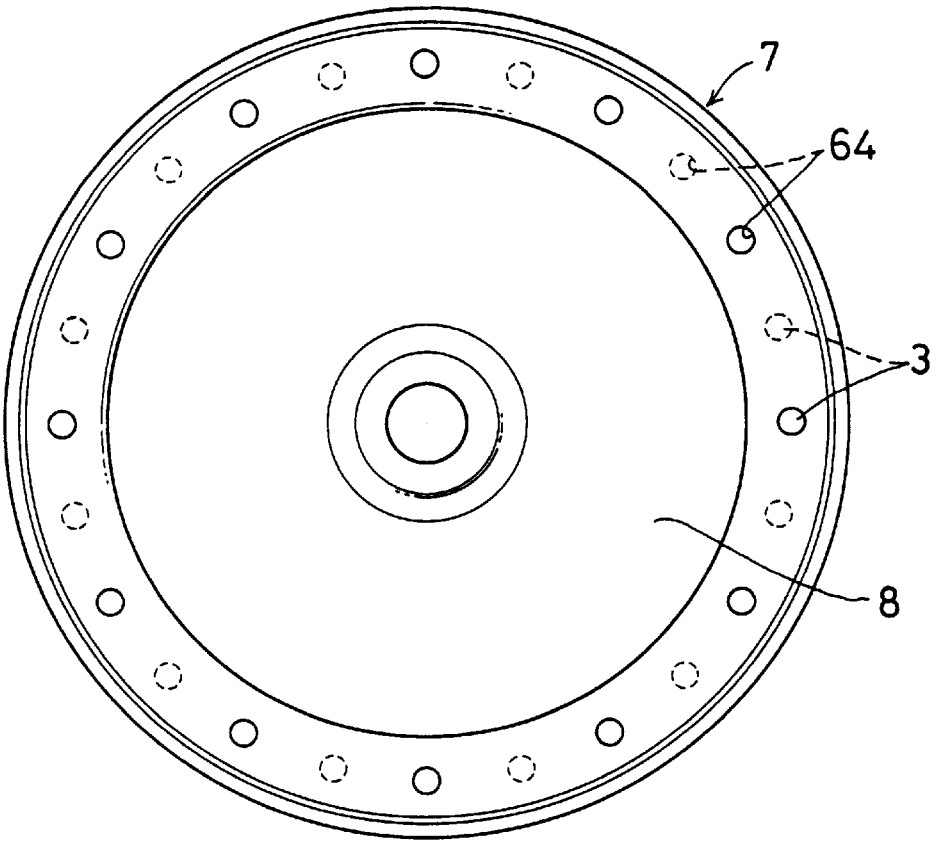
FIG. 17A is a front view of a wheel in which are embedded noise dampers.
Figure 17B:
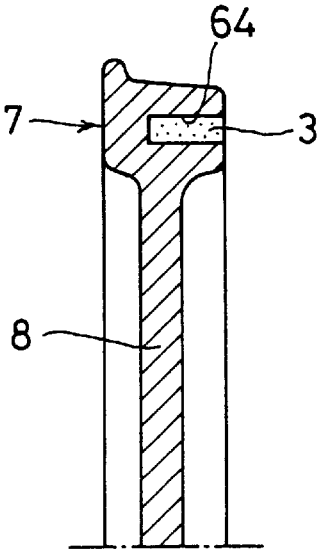
FIG. 17B is a vertical sectional view of the wheel shown in FIG. 17A.
Figure 17C:
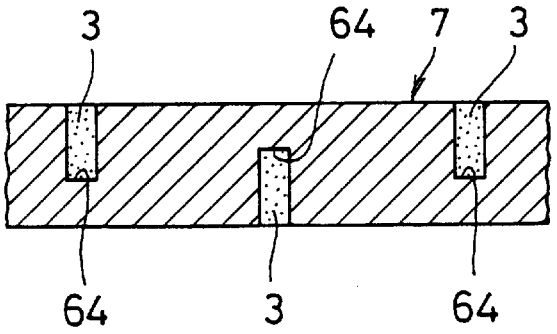
FIG. 17C is a sectional view of the wheel shown in FIG. 17A.

In the embodiment of FIG. 17, numerous small-diameter lateral holes 64 are formed in the front and back surface of the tire of a wheel 7 with the holes in the front surface circumferentially alternating with the holes in the back.

A lead member as a noise damper 3 is inserted in each hole 64. The diameter and the number of lateral holes 64 should be adjusted according to the desired noise damping effect or strength.

By attaching noise dampers 3 to both rails 1 and train wheels 7, it is possible to damp noises produced by both the rails 1 and the wheels 7.

Although not shown, noise dampers 3 may be attached to one side of the brake shoe to reduce braking noises.

FIGS. 18–21 show a noise damper 3 for damping noises produced from rail joints. This noise damper is made from lead and comprises two elongate plates 10 coupled together by a stretchable bellows 11 integral with both plates 10. Each plate 10 has on its front side a plurality of longitudinal ribs 12 and 13 at its upper and lower ends, respectively, and is formed with holes 15 for receiving bolts 14 for coupling rails 2 to a joint plate 9. The plates 10 have tapered top and bottom surfaces 16, 17 complementary to the inner top and bottom surfaces of the joint plate 9. The upper ribs 12 are yieldable upward while the lower ribs 13 are yieldable downward. The bellows 11 absorbs the expansion and shrinkage of rails in the summer and winter periods.

Figure 18:
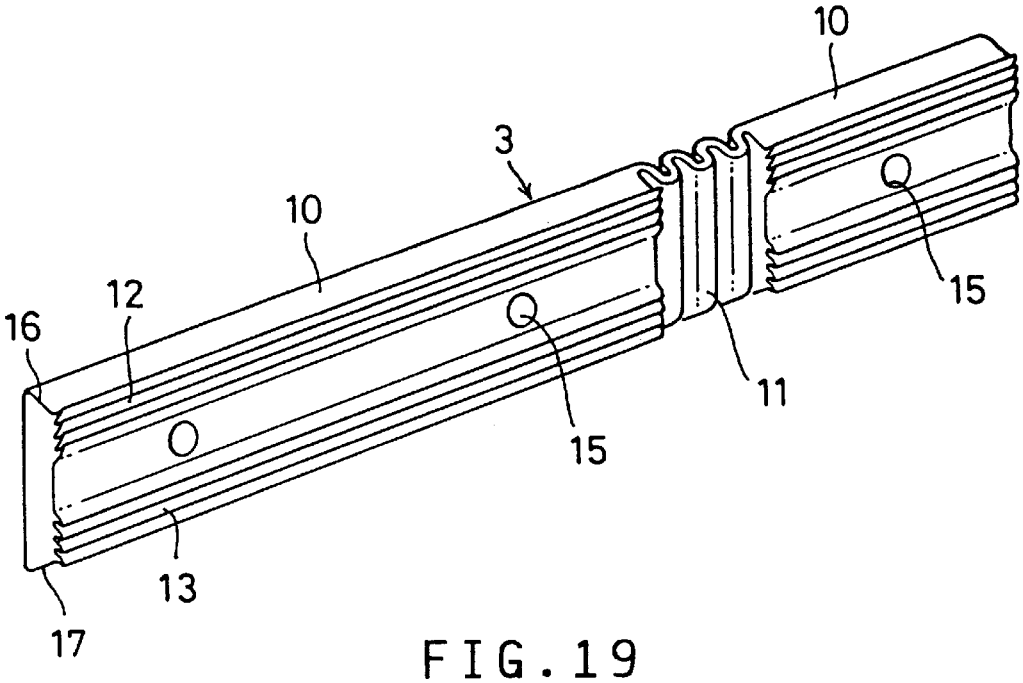
FIG. 18 is a perspective view of a noise damper used at a rail joint.
Figure 19:
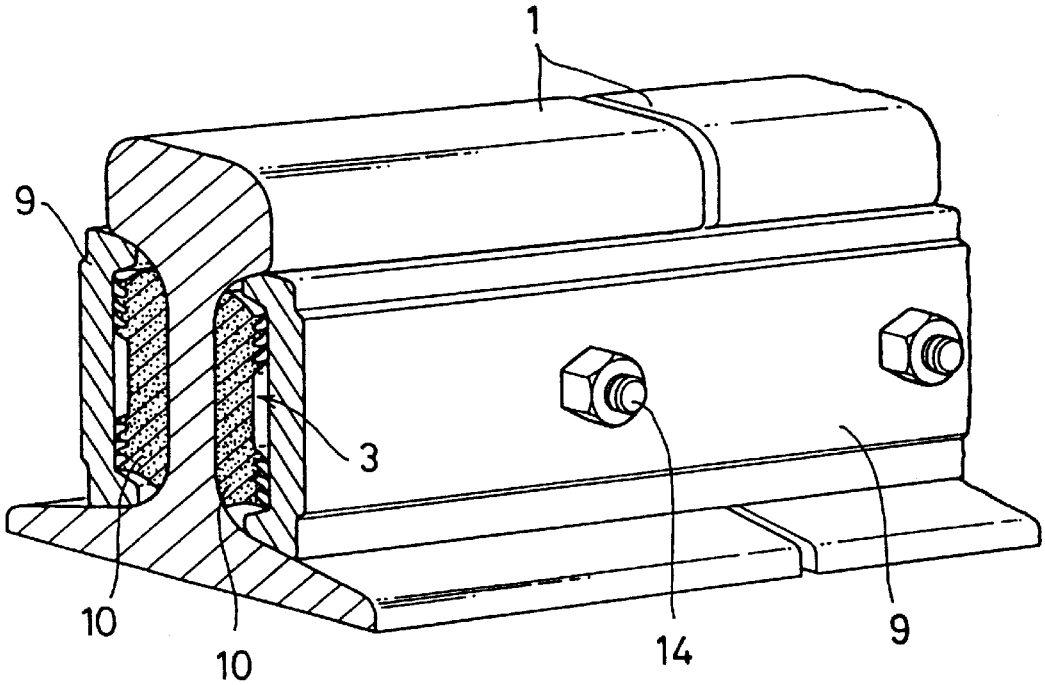
FIG. 19 is a perspective view of a rail joint portion to which are provided two of the noise dampers shown in FIG. 18.

As shown in FIG. 19, rails 1 are joined together by two joint plates 9 with the noise damper shown in FIG. 18 sandwiched between each joint plate 9 and the vertical ribs 2 of the rails 1 so that the bellows 11 is opposite the rail joint.

Figure 20:
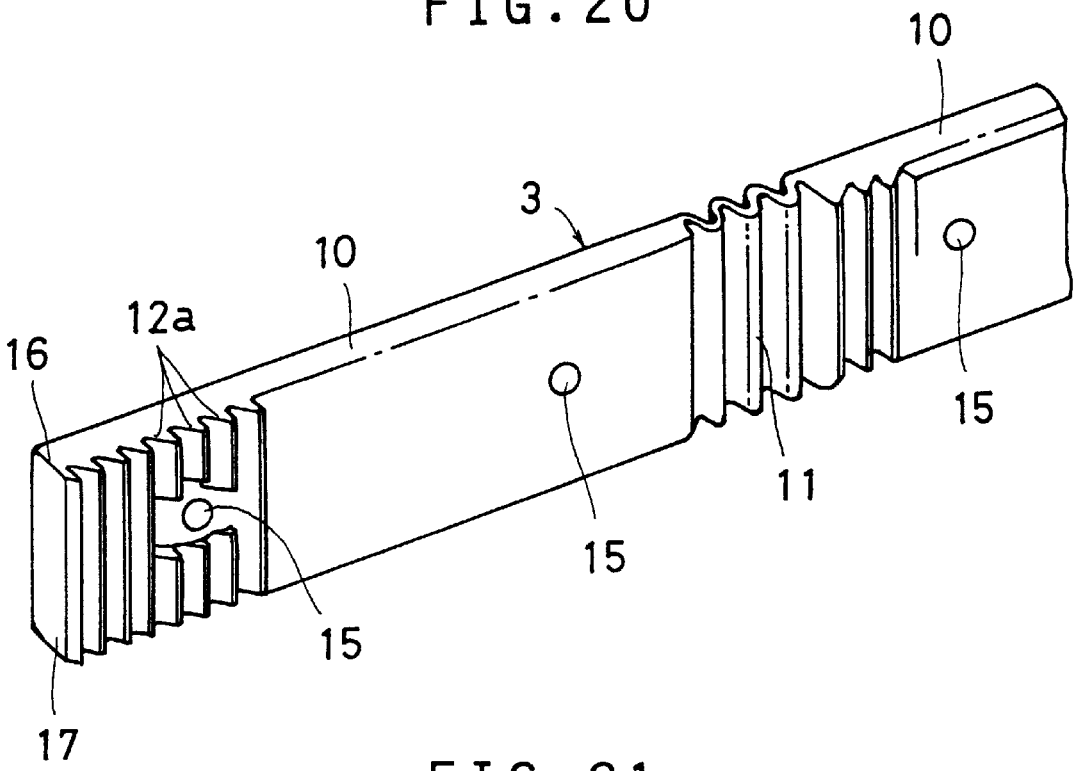
FIG. 20 is a perspective view of a different noise damper used at a rail joint.
Figure 21:
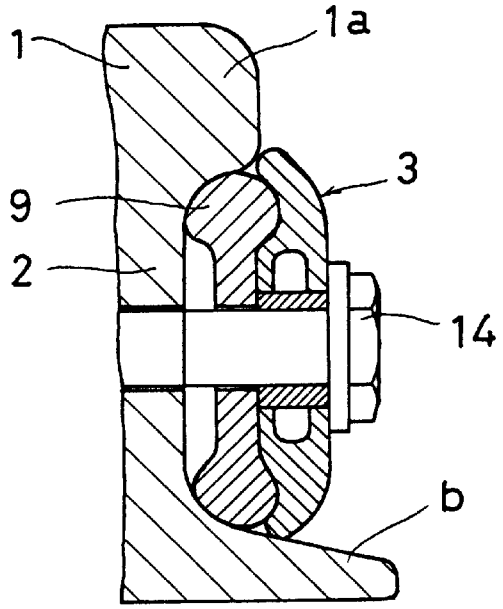
FIG. 21 is a vertical sectional view of a noise damper mounted on a joint bar for joining rails together.

In this state, when the bolts 14 are tightened, the upper and lower ribs 12, 13 of the plates 10 are pressed by the joint plates 9 and bent upward and downward, respectively. The noise dampers 10 are thus compressed to a reduced thickness and brought into close contact with the vertical ribs 2 of the rails 1 and the joint plates 9. Thus, the joint plates 9 can strongly join the rails 1 together without being affected by the noise dampers 3. Since the noise dampers 3 are in close contact with both the rails 1 and the joint plates 9, they can effectively reduce resonance when train wheels impact the rail joint. Instead of the longitudinal, i.e. horizontal ribs 12, 13, vertical ribs 12*a* may be formed on the plates 10 as shown in FIG. 20. The noise dampers 3 may be mounted on the outside of the joint plates 9 by the bolts 14 as shown in FIG. 21.

Figure 22:
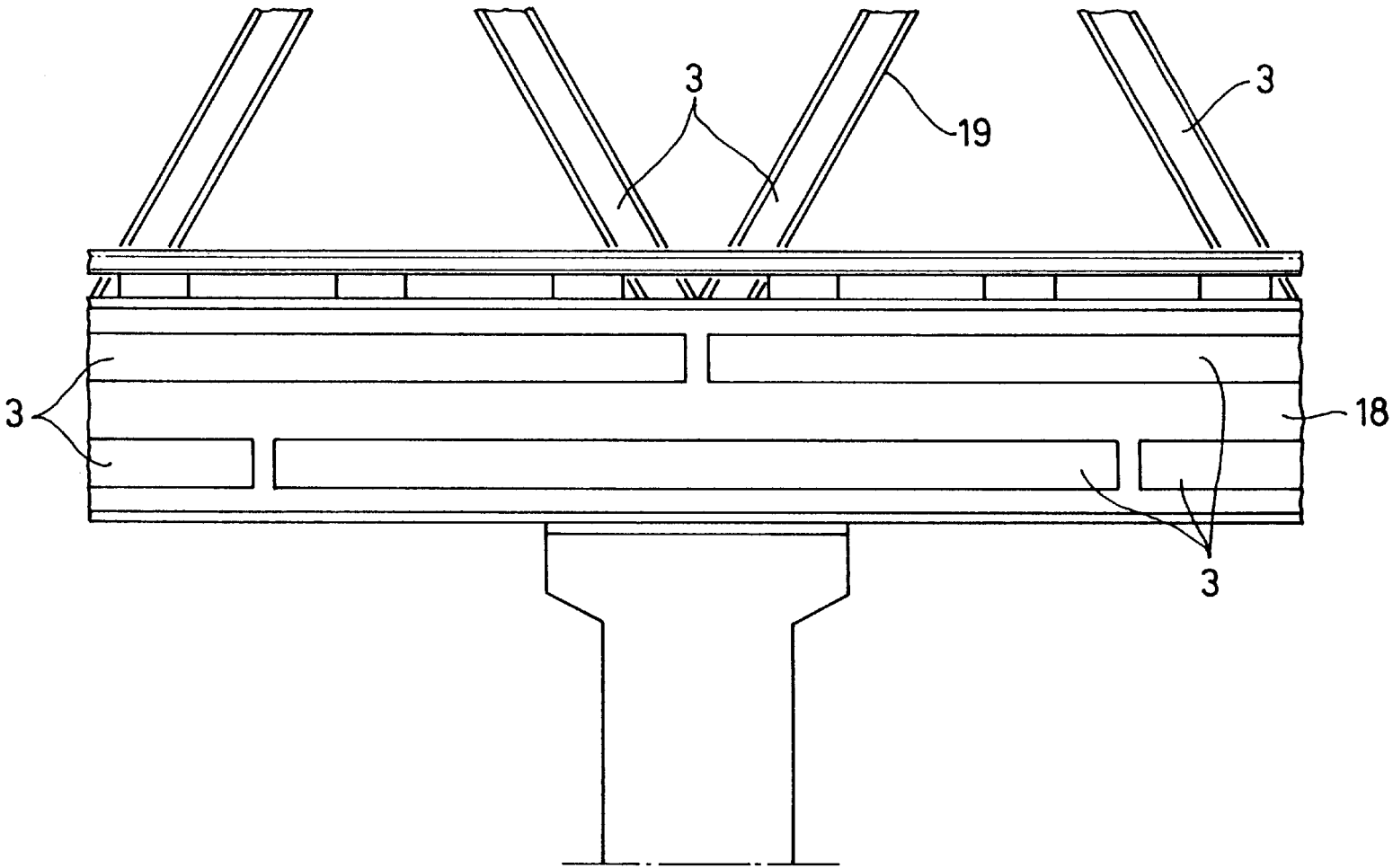
FIG. 22 is a front view of an iron bridge provided with noise dampers.

In the embodiment of FIG. 22, noise damper means 3 are provided on a railroad overpass, iron bridge 18 and truss 19. The overpass and iron bridge 18 are constructed from H-bars. The truss 19 is constructed from steel members having various sectional shapes. Noise dampers 3 similar to those used for rails are mounted, stuck or otherwise secured to the overpass, iron bridge 18 and truss 19.

The noise dampers 3 thus attached suppress noises by absorbing vibration energy transmitted from rails to the overpass, iron bridge 18 and truss 19.

According to this invention, noise dampers are mounted to the rail sides and bottoms, wheel hubs, tires and brake shoes, joint plates between rails, iron bridges and trusses to effectively reduce noises produced when wheels roll on rails. The noise dampers according to the present invention can suppress noises produced by today's high-speed trains, and thus reduce noises heard by people living along railroads.

The noise dampers according to this invention can be easily mounted to existing rails and wheels without changing their basic structure. Moreover, they are durable enough so that no frequent maintenance is necessary.

The noise dampers according to this invention can also be mounted to brand new rails and wheels. Rails and wheels to which are attached such noise dampers can be transported and stored in exactly the same way as with conventional rails and wheels. Since noise dampers are in close contact with rails and wheels, they can very effectively suppress noises.

Embodiments of rail noise damping members are described with reference to FIGS. 23–28.

As shown, a rail noise damping member comprises one, two or all three of a first double-wall side strip 71 bonded to the side of a rail 1 at which wheel flanges are disposed, a second double-wall side strip 72 bonded to the other side of the rail, and a bottom double-wall strip 73 secured to the bottom of the rail at its portions between ties.

Figure 23:
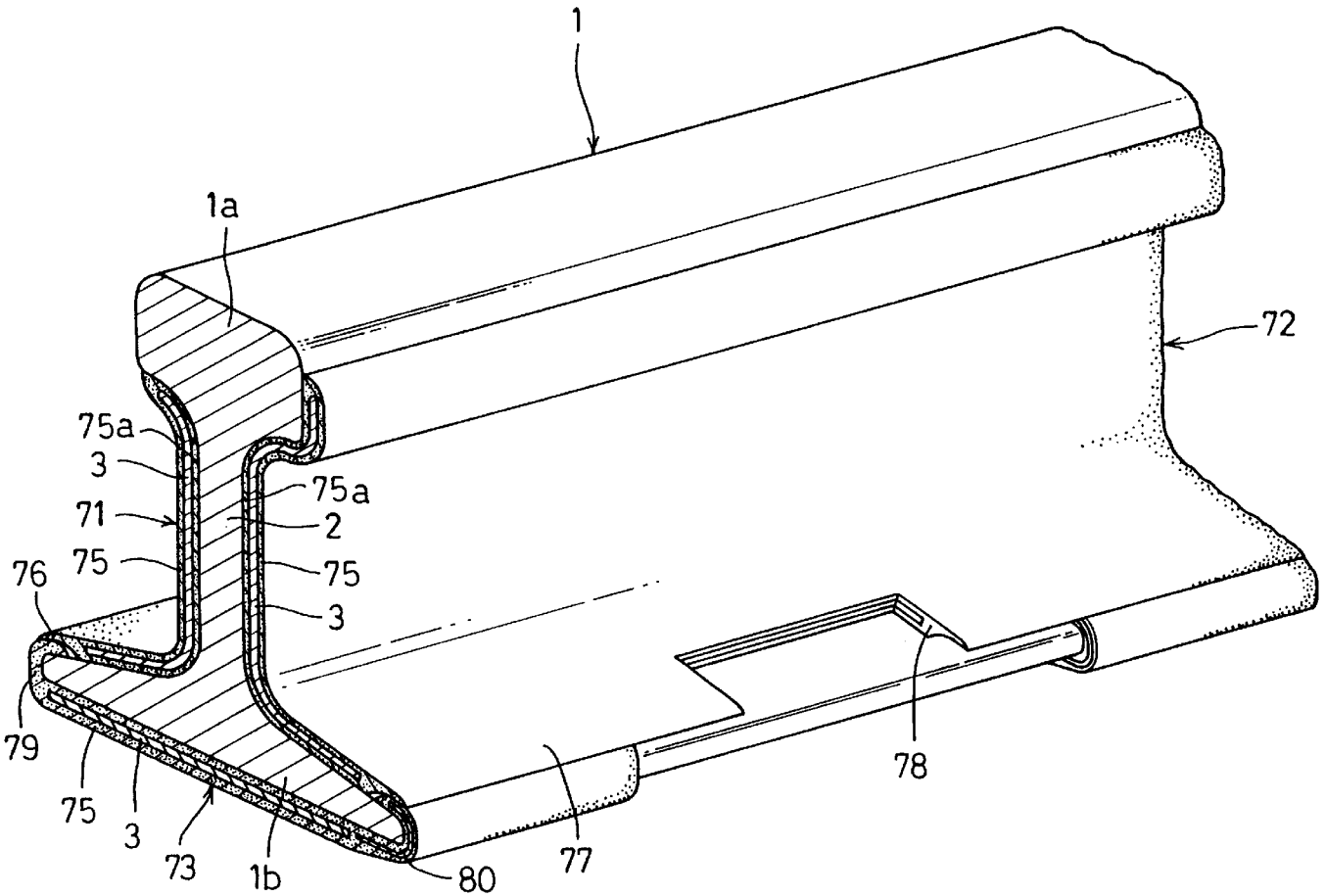
FIG. 23 is a perspective view of another embodiment of the noise damping member mounted on a rail.
Figure 24A:
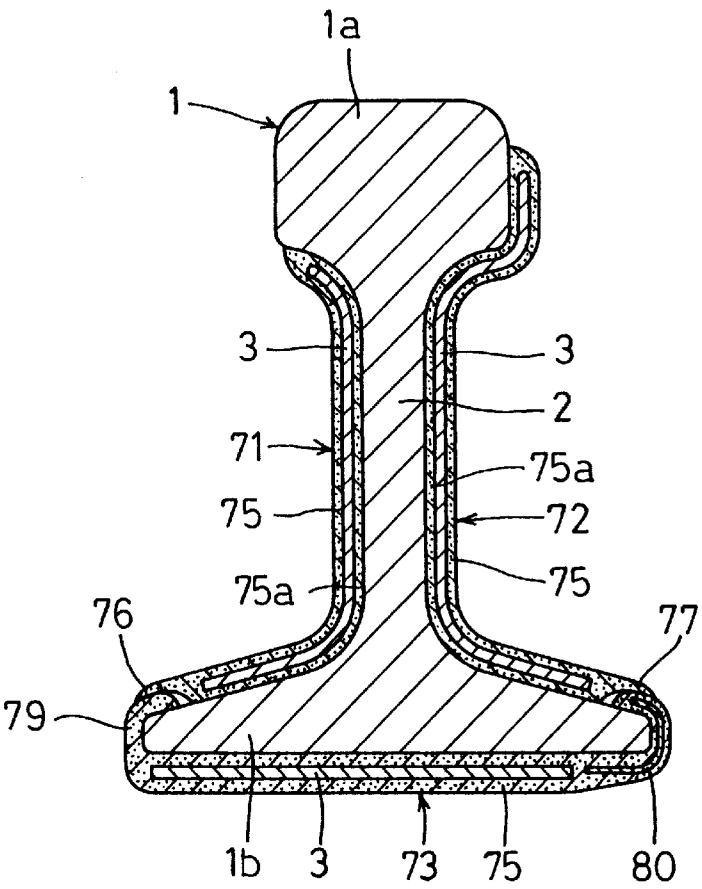
FIG. 24A is a vertical sectional front view of the noise damping member and rail shown in FIG. 23.

The noise damper of the embodiment shown in FIGS. 23 and 24A is comprised of all three strips 71–73. The first and second strips 71 and 72 each comprise a plate-shaped noise absorbing member 3, and resilient members 75 and 75*a* covering both sides of the member 3. The noise absorbing member 3 is a lead plate, while the resilient members 75, 75*a* are made of rubber or a resilient synthetic resin.

The first strip 71 covers the portion of the inner side of the rail 1 including the bottom surface of the head 1*a* of the rail, the side of the rib 2, and the top surface of the bottom 1*b*. The resilient members 75 and 75*a* have at the bottom end thereof an extension 76 overlapping the end of the bottom strip 73. The second strip 72 covers the portion of the other side of the rail 1 including most part of the side face of the head 1*a*, its bottom surface, the side of the rib 2 and the top surface of the bottom 1*b*. An extension 77 is provided at the bottom end of the resilient members 75 and 75*a* of the second strip 72. The lengths of the first and second strips 71, 72 are not limited but preferably about 1–2 meter. A plurality of such strips 71, 72 are stuck on both sides of the rail 1 so as to be continuous with each other.

Made of lead, the noise absorbing member 3 is soft and is deformed easily into close contact with the side of the rail 1 through the inner resilient member 75*a* in conformity with the side shape of the rail simply by pressing it against the side of the rail 1. A plurality of such strips 71, 72 are adhesively bonded to both sides of the rail so as to be continuous with each other with no gaps between the adjacent strips. If any of the strips 71, 72 has a portion which may be a hindrance to a tie-clamping member, this portion should be cut out as at 78. Such a cutout 78 can be easily formed at a construction site with metal shears or a chisel because the strips are made of lead and a resilient material.

Figure 25:
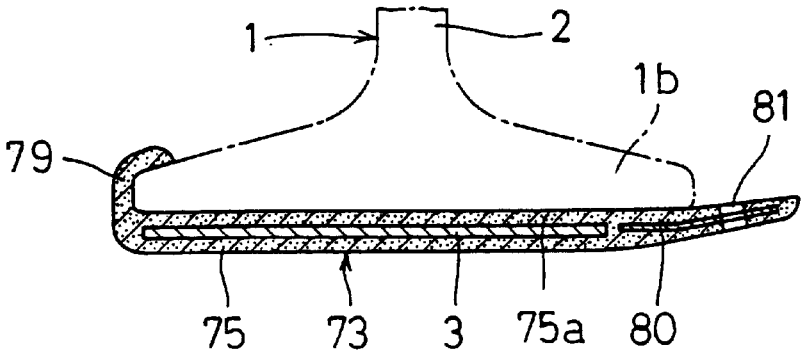
FIG. 25 is a vertical sectional view showing how to set a bottom sheet.

The bottom strip 73 extends substantially the entire width of the bottom 1*b* of a rail 1, and fits between adjacent ties. The strip 73 has at one end thereof a hook portion 79 engaging the bottom 1*b* and at the other end a horizontal end in which is embedded a brass or iron plate core 80 having a tendency to curl upward so that the horizontal end portion can be easily bent upward. A hole 81 is formed in the horizontal end portion (FIG. 25). To set the bottom strip 73 under the rail 1, a rod is slid under the rail, its tip is engaged in the hole 81, and the rod is pulled together with the strip 73. In this state, the other end of the strip 73 is bent upward into close contact with the other end of the bottom 1*b*.

Figure 24B:
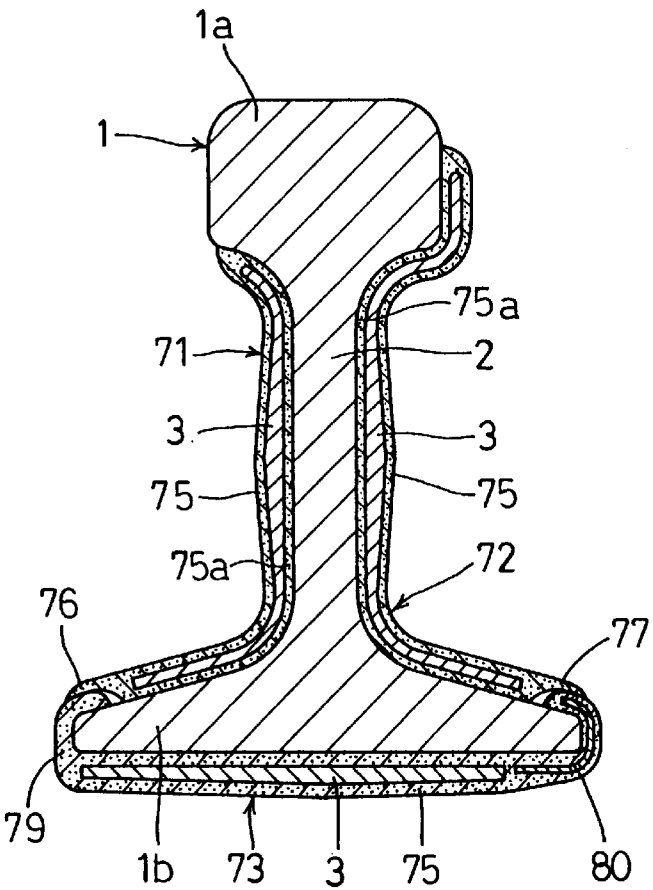
FIG. 24B is a similar view of a further embodiment.

In the embodiment shown in FIG. 24B, each of the noise-absorbing members 3 of the strips 71, 72 and 73 has a greater thickness and thus a greater weight at its central portion. With this arrangement, it is possible to more effectively damp noises because the rail tends to vibrate most violently at the central portion of the rib and at the central portion of the rail bottom.

Figure 26:
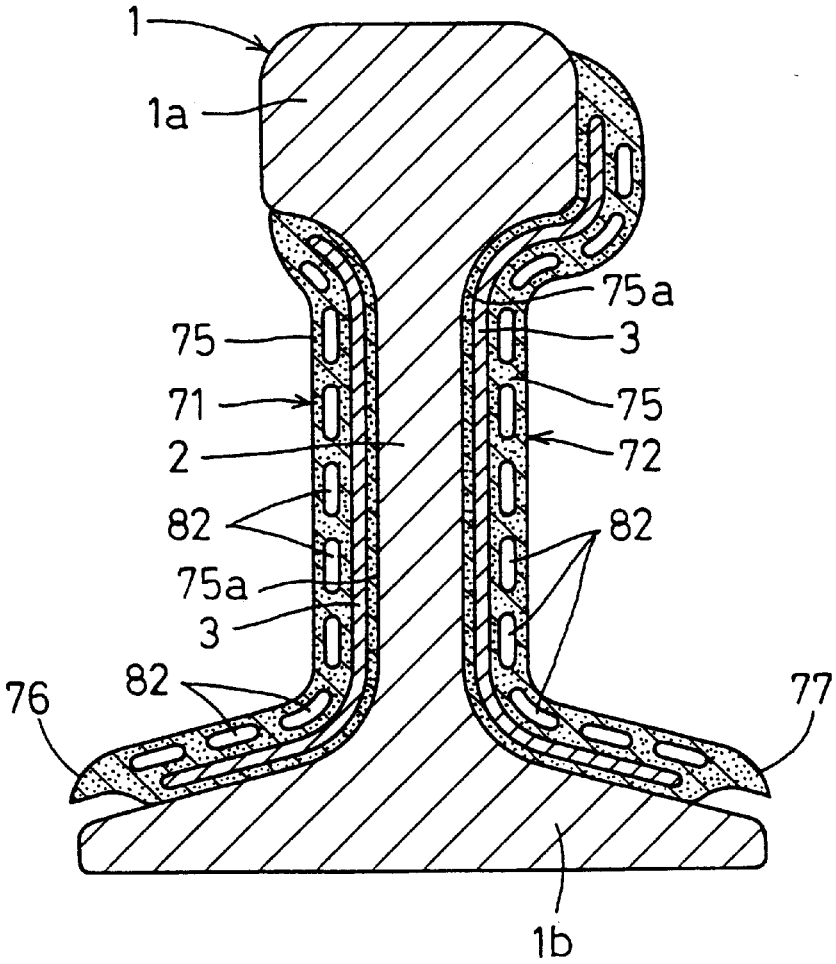
FIG. 26 is a vertical sectional view showing a still another embodiment.

In the embodiment shown in FIG. 26, numerous longitudinal gaps 82 are formed in the noise-absorbing members 3 of the first and second strips 71, 72. The gaps 82 disturb and damp escaping noises.

Figure 27A:
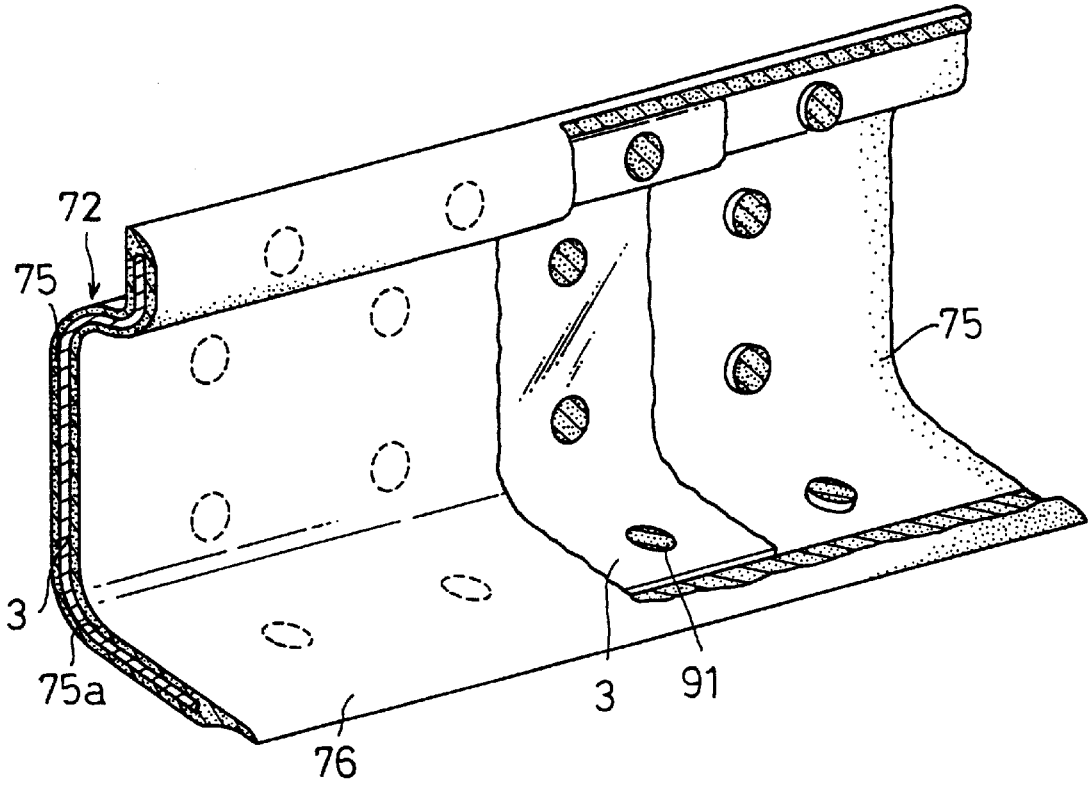
FIG. 27A is a perspective view of another embodiment.
Figure 27B:
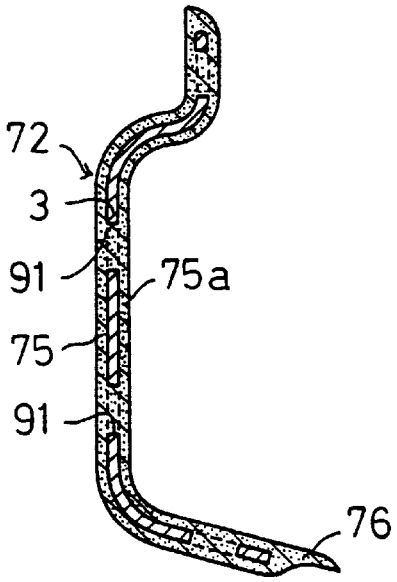
FIG. 27B is a vertical sectional view of the embodiment illustrated in FIG. 27A.

In the embodiment shown in FIGS. 27A and 27B, many through holes 91 are formed in the noise-absorbing member 3 of any of the strips 71, 72 and 73. The outer resilient members 75, 75*a* partially engage in the holes 91, so that the resilient members 75, 75*a* are strongly joined to the member 3. This prevents the sagging of the resilient members 75, 75*a*. In this arrangement, the noise-absorbing member 3 and the resilient members 75, 75*a* are formed by molding.

Besides the illustrated round holes, the through holes 91 formed in the noise-absorbing member 3 may be elongate holes, slits or of any other shape. Their number and how they are arranged are not limited, either. The concept of this embodiment is applicable to any of the abovementioned embodiments.

Figure 28:
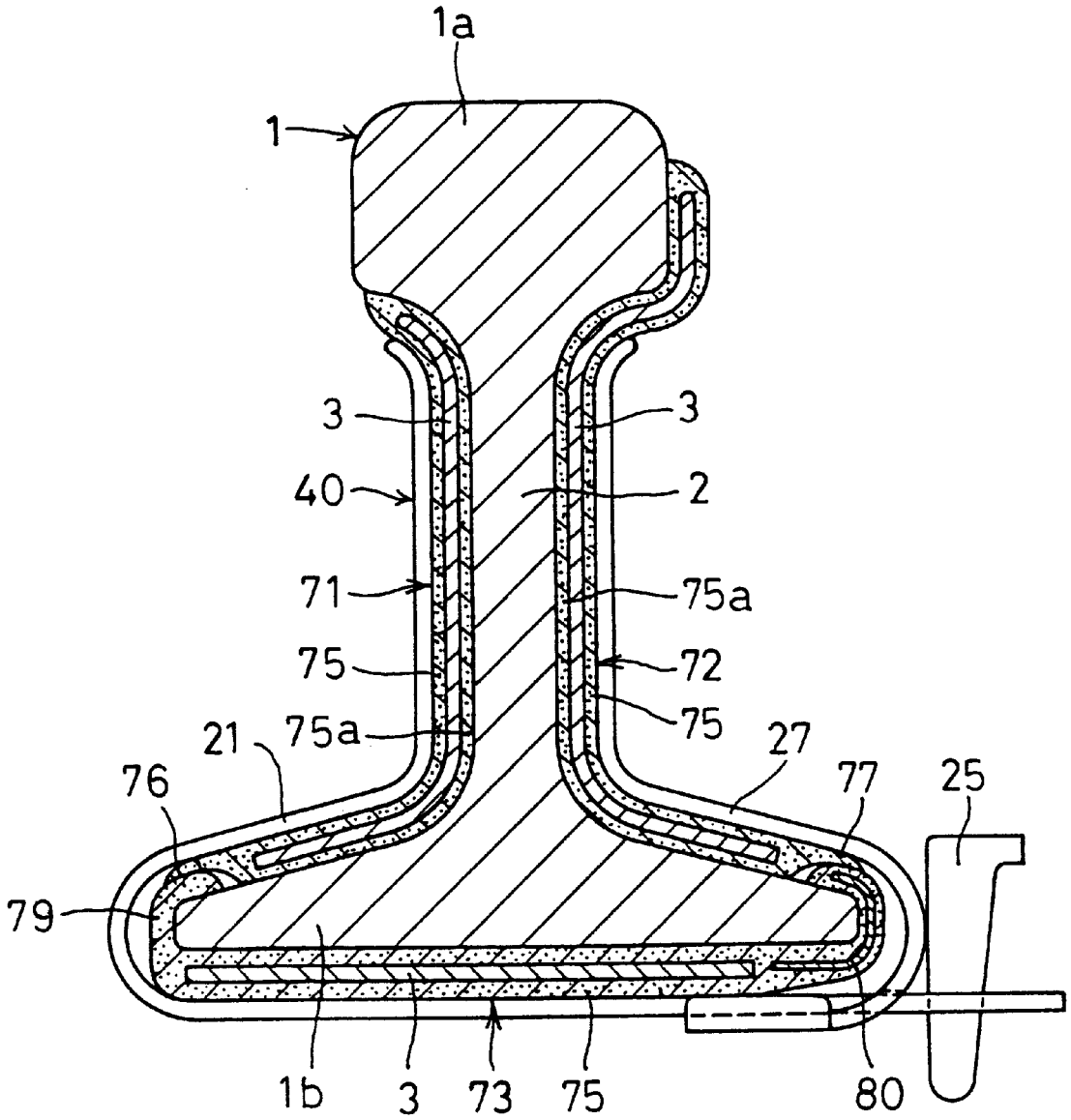
FIG. 28 is a vertical sectional view of a still further embodiment mounted with an example of clamp means.

In the embodiment shown in FIG. 28, a clamp means 40 is provided to prevent the respective ends of the strips adhesively bonded to the rail 1 from peeling off. The clamp means 40 comprises a first clamp member 21 bent along the surface of the rail so as to cover the area from one side of the rib 2 to the bottom surface of the bottom flange, a second clamp member 27 bent along the surface of the rail so as to cover the area from the other side of the rib 2 to the bottom of the rail, and a wedge 25 adapted to be driven into the end of the first clamp member 21. The wedge 25 is driven into the first clamp member 21 with the first and second clamp members 21 and 27 superposed on the strips 71, 72 and 73 bonded to the rail 1 to tighten the clamp members 21, 27 and thus to secure the ends of the strips 71, 72 and 73 to the rail.

The strips 71, 72 and 73 are adhesively bonded to both sides and the bottom surface of a rail 1. The noise-absorbing member 3 of each strip is rigidly fixed to the rail 1 by the inner resilient member 75*a* because the member 75*a* has high bond strength.

When impacts are transmitted through the rail head 1*a* and rib 2 to the bottom flange 1*b* by a train wheel rolling on the rail, the inner resilient members 15*a* of each strip initially absorbs and reduces noises and vibrations due to impacts on the rail because they are in close contact with the rail. Then, the noise-absorbing member 3, which is made of lead and thus soft and heavy, considerably reduces noises and vibrations due to impacts on the rail by absorbing them. Further, the outer resilient member 75 prevents an escape of noises and vibrations. Similarly, the strips absorb vibration energy being transmitted from the bottom of the rail 1 to the road bed, thus reducing noises further.

Sounds are vibrations of air. Iron, having a body-centered crystalline structure, produces high-pitched sounds when it vibrates even slightly. This tendency is especially strong with steel, a kind of iron of which rails are made, because steel contains carbon.

Lead, on the other hand, has a face-centered crystalline structure, and is soft and has a large specific gravity. Thus, lead can effectively absorb vibration and thus acoustic energy from a sound source. Also, because of its large specific gravity, lead can effectively prevent resonance. Overall, lead is a very good noise damper.

The more closely lead is in contact with steel, the more effectively lead can damp noises. That is why the noise damping strips according to the invention are adhesively bonded to the rail. By bonding such strips to both sides and bottom of the rail, it is possible to damp vibrations and noises extremely effectively.

The first, second and third strips 71, 72 and 73 can be bonded to either of rails already in service or newly made rails at any portions thereof, e.g. at its straight portions or curved portions (where squeaking noises tend to be produced), or at rail joints (where loud impact noises tend to be produced).

Lead, a material used as noise dampers according to the invention, has a thermal expansion coefficient more than twice that of steel, a material for rails and train wheels. But the lead cores of the strips will never peel because the amount of lead attached to the rail is negligibly small compared with the entire mass of the rail, and further because the lead core can thermally expand relatively freely in the resilient members 75, 75*a*.

What is claimed is:

1. A noise damping arrangement for damping noise produced from a joint portion between rails that each comprise an elongated head, a narrow pillar portion having side surfaces and being integral with the head, and a base that is integral with the pillar portion, said arrangement comprising:

two elongated lead plates each having a first side surface complementarily shaped relative to one of the side surfaces of the pillar portion of the rail, and a second side surface formed with a plurality of longitudinal ribs, each of said lead plates being mounted to said rail so as to extend across the joint portion with said first side surface closely pressed against one of the side surfaces of the pillar portion and said second side surface facing outwardly, wherein each of said lead plates comprises two plate portions coupled together by a bellows; and elongated joint plates each having an inner side surface and being mounted to said rail so as to extend across the joint portion with said inner side surface being pressed against the second side surface of one of said lead plates.

2. A rail comprising: an elongated head;

a narrow vertical rib integrally connected to said head;

a base integrally connected to said rib, wherein said rib is formed with an interior vertical groove that extends through said rib and said base and opens at a bottom of said base; and a noise-damping member received in said interior groove such that said noise-damping member is disposed within said rib and said base.

3. The rail as claimed in claim 1, wherein said noise-damping member is formed of lead.

4. A rail comprising:

an elongated head;

a narrow vertical rib integrally connected to said head;

a base integrally connected to said rib, said base having a recess formed in a bottom portion thereof; and a noise-damping member received in the recess, which is formed in said bottom portion of said base, such that said noise-damping member is covered by said base.

5. The rail as claimed in claim 4, wherein said noise-damping member is-formed of lead.

* * * * *